US006850219B2

(12) United States Patent
Aoyama et al.

(10) Patent No.: US 6,850,219 B2
(45) Date of Patent: Feb. 1, 2005

(54) DISPLAY DEVICE

(75) Inventors: Tetsuya Aoyama, Hitachi (JP); Shinichi Komura, Hitachi (JP); Ikuo Hiyama, Hitachi (JP); Tsunenori Yamamoto, Hitachi (JP); Yoshiyuki Kaneko, Hachioji (JP); Mitsuji Ikeda, Hitachinaka (JP); Osamu Itou, Hitachi (JP); Hideo Satou, Hitachi (JP); Shoichi Hirota, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 211 days.

(21) Appl. No.: 09/864,311

(22) Filed: May 25, 2001

(65) Prior Publication Data

US 2002/0011980 A1 Jan. 31, 2002

(30) Foreign Application Priority Data

Jun. 9, 2000 (JP) ..... 2000-173567

(51) Int. Cl.[7] ..... G09G 3/36

(52) U.S. Cl. ..... 345/103; 345/55; 345/60; 345/87; 345/92; 345/103; 345/204; 345/694

(58) Field of Search ..... 345/55, 60, 87, 345/90–92, 98–100, 103, 204, 694, 698, 88, 95, 96, 97; 349/1, 5, 12

(56) References Cited

U.S. PATENT DOCUMENTS

| | | | | | |
|---|---|---|---|---|---|
| 4,779,083 | A | * | 10/1988 | Ishi et al. | 340/767 |
| 5,751,278 | A | * | 5/1998 | Inamori et al. | 345/211 |
| 6,232,941 | B1 | * | 5/2001 | Ode et al. | 345/95 |
| 6,466,192 | B2 | * | 10/2002 | Imamura | 345/98 |
| 6,493,263 | B1 | * | 12/2002 | Shibata et al. | 365/185.18 |
| 2001/0024183 | A1 | * | 9/2001 | Ode et al. | 345/87 |
| 2002/0130881 | A1 | * | 9/2002 | Kudo et al. | 345/581 |

* cited by examiner

*Primary Examiner*—Henry N. Tran
(74) *Attorney, Agent, or Firm*—Antonelli, Terry, Stout & Kraus, LLP

(57) ABSTRACT

A display device is constituted by a display module which determines a plurality of pieces of pixels as belonging to one block unit, selects the plurality of pixels in each block unit at the same time and displays a picture image by adding one or a plurality of specific patterns each having different spatial frequencies of each block unit; a display control unit which controls the display module; a picture image signal generation unit which generates picture image signals; and a computing circuit which generates the specific patterns each having different spatial frequencies while weighting the same based on the picture image signals for every block unit. Thereby, a display device which reduces the signal clock frequency as well as increases the signal writing time, enhances the opening rate of an LC panel and permits a highly fine display and a high speed motion picture display, is obtained.

29 Claims, 17 Drawing Sheets

FIG. 2 -PRIOR ART
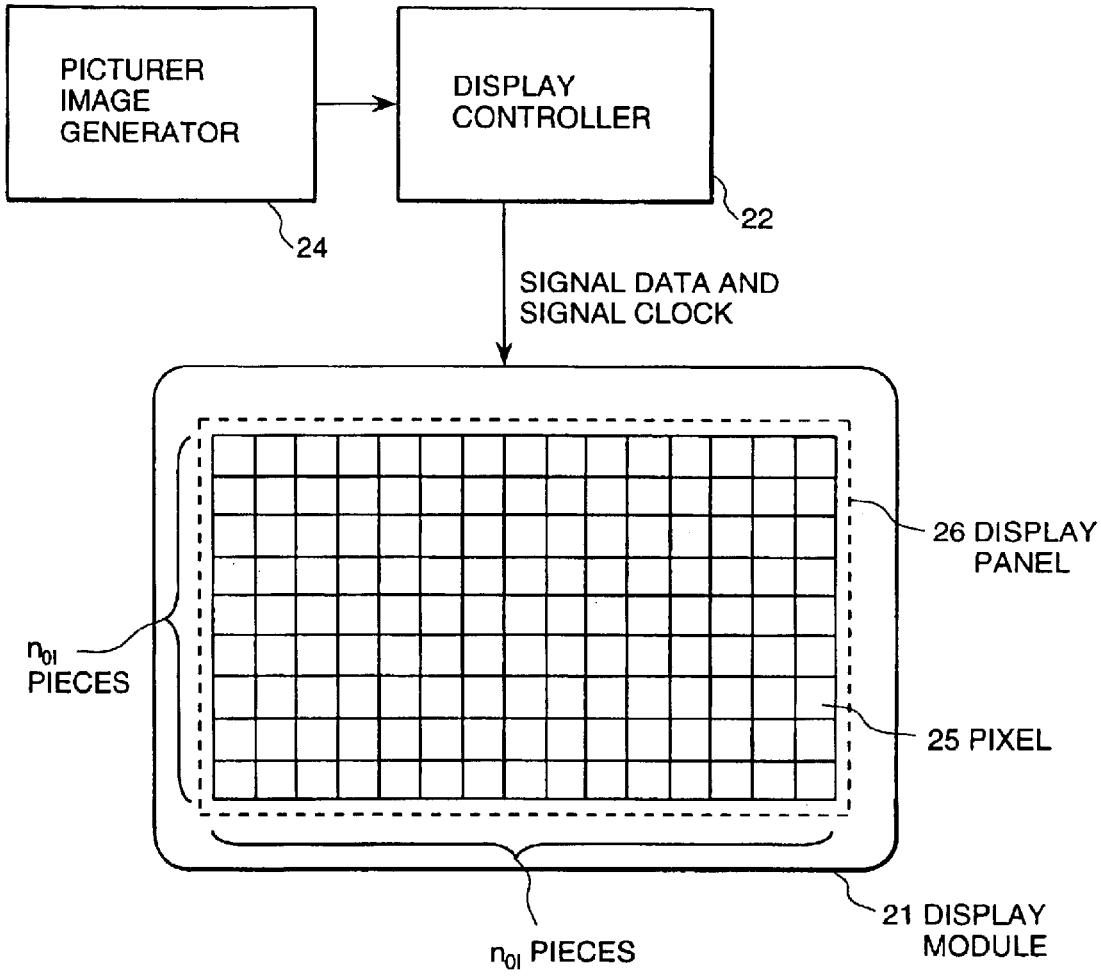

FIG. 3 -PRIOR ART
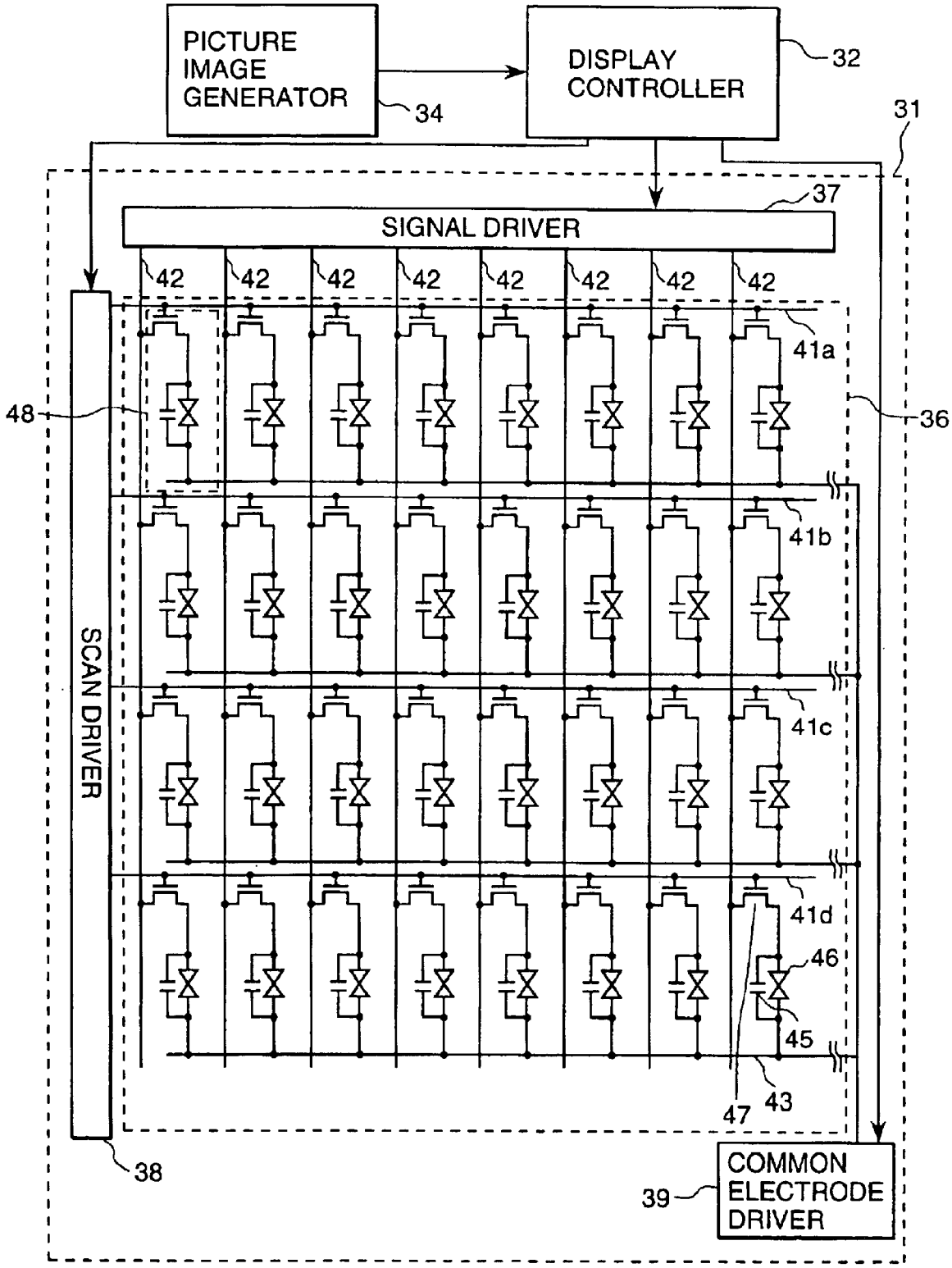

DISPLAY DEVICE

BACKGROUND OF THE INVENTION

1. Field of the Invention

The present invention relates to a display device and, in particular, relates to a display device which permits a highly fine display and a high frequency drive.

2. Conventional Art

FIG. 2 is a diagram showing a common structure of conventional display devices. As shown in FIG. 2, the conventional display devices such as a liquid crystal (herein below will be indicated as LC) display device and a plasma display panel include a display module 21 provided with a display panel 26 in which pixels of $n_{0l}$ pieces in line direction and of $n_{0r}$ pieces in row direction are arranged in a matrix shape, a display control unit 22 which controls the display module 21 and a picture image signal generation unit 24 which generates picture image signals.

When displaying picture images on the display panel 26 at a drive frequency of $f_H$, $n_{0l} \times n_{0r}$ pieces of picture image signals have to be sent to the display module 21 for every cycle of $1/f_H$, therefore, signal clock frequency $f_S$ for sending the picture image signals from the display control unit 22 to the display module 21 is defined by the following equation (1). Wherein, such as a fly-back time is neglected.

$$f_S = n_{0l} \times n_{0r} \times f_H \tag{1}$$

Since the signal clock frequency is proportional to the number of pixels and the drive frequency, the signal clock frequency increases depending on an increase of pixel number due to highly fine display requirement and due to a high speed drive of the display device.

Now, writing of data signals will be explained with reference to an active matrix type LC display device as an example.

FIG. 3 is a diagram showing a structure of the system and a structure within a display panel in a conventional display device. As shown in FIG. 3, the conventional active matrix type LC display device includes a display panel 36 in which pixels 48 are arranged in a matrix shape, a display module 31 provided with a signal driver 37, a scan driver 38 and a common electrode driver 39, a display control unit 32 which controls the display module 31 and a picture image signal generation unit 34 which generates picture image signals.

To the signal driver 37 signal lines 42 are connected, to the scan driver 38 scan lines 41*a*, 41*b*, 41*c*, 41*d*, . . . are connected and to the common electrode driver 39 common electrode lines 43 are connected. Each of the pixels 48 is provided with a thin film transistor (TFT) 47, a capacitance element 45, and a signal electrode (not shown) and an opposing electrode (not shown) for applying a voltage to an LC element 46, the signal electrode is connected to one of the signal lines 42 via the concerned TFT 47 and the opposing electrode is connected to one of the common electrode lines 43.

A driving method of the LC elements 46 through voltage application is performed by sequential line scanning which will be explained hereinbelow. An address signal is sequentially applied by the scan driver 38 to the scan lines 41*a*, 41*b*, 41*c*, 41*d*, . . . to scan the same. All of the TFTs 47 for one line which are connected to one of the scan lines applied of the address signal are turned ON and potential differences between potentials applied to the signal lines by the signal driver 37 and the potential applied to the common electrode line by the common electrode driver 39 are applied to the respective LC elements 46 and capacitance elements 45.

When driving the display panel 36 having $n_{0l}$ pieces of scan lines, in that $n_{0l}$ pieces of pixels in the line direction through a sequential line scanning at the drive frequency of $f_H$, all of the scan lines have to be scanned within a cycle of $1/f_H$, therefore, time span when the address signal is applied to one scan line, in that the time $t_S$ allowed for writing a data signal is expressed in the following equation (2). Wherein the fly-back time is likely neglected.

$$t_S = 1/f_H \times n_{0l} \tag{2}$$

Therefore, the time for writing data signal is anti-proportional to the number of scan lines and the drive frequency. Namely, the time for writing data signal decreases depending on the increase of the scan line number due to a highly fine display requirement and due to a high speed drive of the display device, and a problem of shortage of time for writing signal data is likely to arise.

As has been explained above, in the conventional display devices, the signal clock frequency increases depending on the increase of the pixel number in the display module and the increase of the drive frequency. For this reason, the power consumption of the display devices increases as well as ICs which permit a high speed operation are required.

Further, in the display devices which make use of the line sequential scanning drive, the time when one line is selected decreases depending on the increase of the pixel number in the line direction and the increase of the drive frequency. As a result, the time for writing signals is decreased.

Still further, a ratio of an area associating with wirings with respect to an area for the pixels increases depending on the increase of the highly fine display requirement, resultantly, an opening rate of the display panel reduces.

SUMMARY OF THE INVENTION

An object of the present invention is to provide a display device which reduces the signal clock frequency, increases the time for writing signals, raises the opening rate and permits a highly fine display as well as a high speed motion picture display.

In order to achieve the above object, the present invention proposes a display device which comprises a display module which determines a plurality of n (n is an integer equal to or more than 2) pieces of pixels as one block unit, selects the plurality of pixels in each block unit at the same time and displays a picture image by making use of one or a plurality of specific patterns having different spatial frequencies of each block unit; a display control unit which controls the display module; a picture image signal generation unit which generates picture image signals; and a computing circuit which generates the specific patterns each having different spatial frequencies while weighting the same based on the picture image signals for every block unit.

The computing circuit is a means for generating n pieces of specific patterns having different spatial frequencies which are weighted based on the picture image signals for every block unit, and the display module is a means for displaying a picture image by making use of $N_P$ (which is an integer smaller than n) pieces of the specific patterns.

Further, a compression rate regulation unit can be provided as a means for modifying the number of pieces $N_P$ of the specific patterns to be used.

Still further, a high compression rate computing circuit can be provided as a means for modifying the number of the specific patterns to be used for every block unit.

Further, the present invention proposes a display device which comprises a display module which includes a panel in which pixels are arranged in a matrix shape, a signal driver, a scan driver and opposing signal driver; signal lines connected to the signal driver; scan lines connected to the scan driver; and opposing signal lines connected to the opposing signal driver; wherein each of the pixels includes a signal electrode, opposing signal electrode and a switching element, the signal electrode is connected to one of the signal lines via the switch element, the opposing signal electrode is connected to one of the opposing signal lines, a first potential is applied to the signal electrodes provided for the pixels on a same line included in a same block unit, a second potential is applied to the opposing signal electrodes provided for the pixels on a same row included in a same block unit, a certain specific pattern is formed by the first and second potentials for the same block unit concerned and one of the common opposing signal lines is connected to the opposing signal electrodes provided for the pixels on the same line.

Further, the present invention proposes a display device which comprises a display module which includes a panel in which pixels are arranged in a matrix shape, a signal driver, a scan driver and opposing signal driver; signal lines connected to the signal driver; scan lines connected to the scan driver; opposing signal common lines connected to the opposing signal driver and opposing signal lines connected to the opposing signal common lines; wherein each of the pixels includes a signal electrode, opposing signal electrode and a switching element, the signal electrode is connected to one of the signal lines via the switch element, the opposing signal electrode is connected to one of the opposing signal lines, a first potential is applied to the signal electrodes provided for the pixels on a same line included in a same block unit, a second potential is applied to the opposing signal electrodes provided for the pixels on a same row included in a same block unit, a certain specific pattern is formed by the first and second potentials for the same block unit concerned and one of different opposing signal lines is connected to the opposing signal electrodes provided for the pixels included in a different block unit.

Further, the present invention proposes a display device which comprises a display module which includes a panel in which pixels are arranged in a matrix shape, a signal driver, a scan driver and opposing signal driver; signal lines connected to the signal driver; scan lines connected to the scan driver; opposing signal common lines connected to the opposing signal driver and opposing signal lines connected to the opposing signal common lines; wherein each of the pixels includes a signal electrode, opposing signal electrode and a switching element, the signal electrode is connected to one of the signal lines via the switch element, the opposing signal electrode is connected to one of the opposing signal lines, a first potential is applied to the signal electrodes provided for the pixels on a same line included in a same block unit, a second potential is applied to the opposing signal electrodes provided for the pixels on a same row included in a same block unit, a certain specific pattern is formed by the first and second potentials for the same block unit concerned and one of different opposing signal lines is connected to the opposing signal electrodes provided for the pixels in a different block unit, and respectively different opposing signal lines are connected to the opposing signal electrodes provided for the pixels on different lines included in a same block unit.

Number of pixels in line direction in a block unit can be larger than the number of pixels in row direction in the block unit.

A combination of a plurality of pixels which constitute a block unit can be varied.

Further, the display module is a projection type display, and the projection type display includes a projection pattern display source which displays specific patterns and a pattern display element, and the pattern display element includes a pair of substrates on which a transparent electrode is formed, a photo conductive layer formed on the transparent electrode and an LC layer sandwitched by the pair of substrates.

The display module can be constituted as a means for sequentially displaying specific patterns and adding picture images.

Further, the display module can be a means for displaying picture images while computing specific patterns in the pixels and adding the same.

In the above instance, the display module includes a panel in which pixels are arranged in a matrix shape, a signal driver, a scan driver and a common electrode driver; signal lines connected to the signal driver; scan lines connected to the scan driver; and common electrode lines connected to the common electrode driver, wherein each of the pixels is provided with an adder-subtractor for adding the specific patterns, and the signal lines of which number is equal to the number NP of specific patterns to be added are connected to the adder-subtractor.

More specifically, the panel is an LC panel provided with a LC for the pixels, each of the pixels is provided with capacitance elements of more than NP pieces corresponding to the number of the specific patterns to be added which hold signals sent via the concerned signal line, and means for coupling the capacitance element and the capacitance of the LC.

Each circuit which constitutes each pixel can include a sample hold means for digital signal and another sample hold means for analogue signals.

The signal held in the sample hold means for analogue signals is rewritten depending on the signal held in the sample hold means for digital signals to provide a same signal for the pixels included in a same block unit.

Further, the picture image signal generation unit can include the computing circuit, alternatively the display control unit can include the computing circuit and further alternatively the display module can include the computing circuit.

Still further, a typical display module is an LC display module.

BRIEF DESCRIPTION OF THE DRAWINGS

FIG. 2 is a diagram showing a common structure of conventional display devices;

FIG. 3 is a diagram showing a system structure and a structure within a display panel of a conventional display device;

DETAILED DESCRIPTION OF THE PREFERRED EMBODIMENTS

Figure 1A:
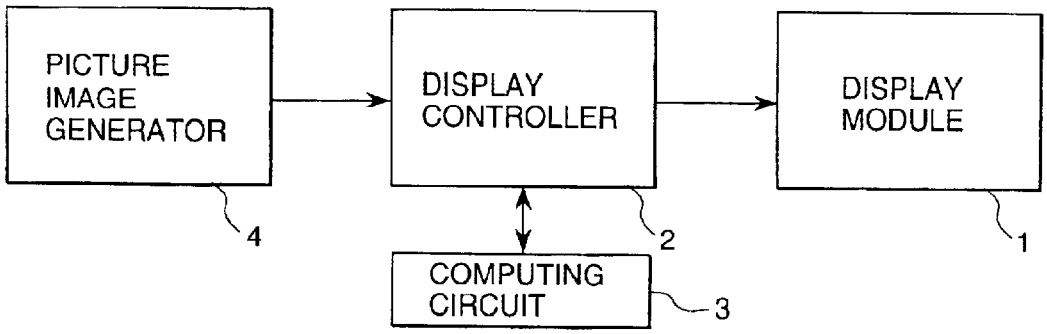
FIGS. 1A through 1C are block diagrams showing an entire structure of a display device according to the present invention and diagrams showing the operations principle thereof.
Figure 1B:
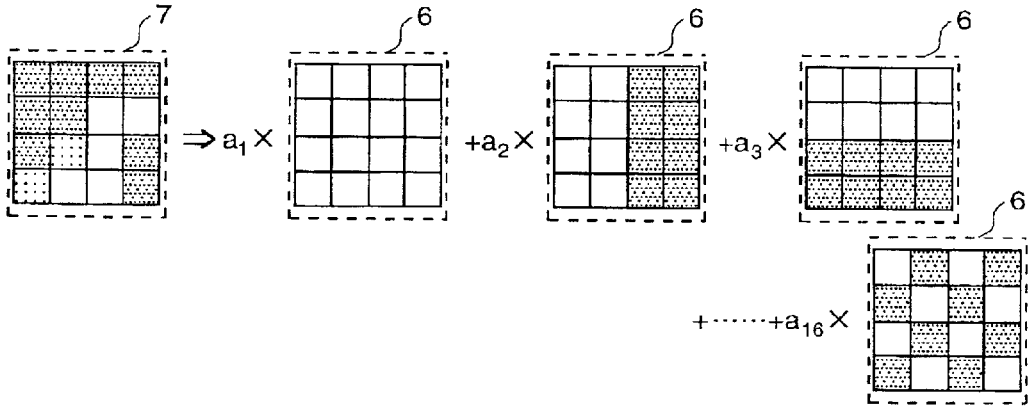
Figure 1C:
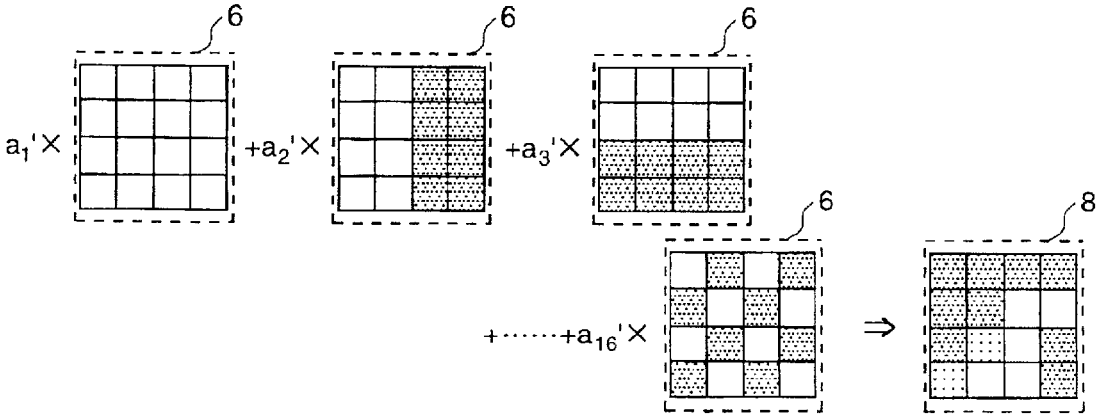

FIGS. 1A through 1C are block diagrams for showing an entire structure of a display device according to the present invention and for explaining an operating principle thereof. When applying onto picture images an orthogonal transformation which is utilized for picture image compression technology such as MPEG (Moving Picture Experts Group) and JPEG (Joint Photographic Experts Group), a picture image 7 formed in a certain block within a whole picture image can be expressed by a weighted linear summation of specific patterns 6 having a variety of spatial frequency components as shown in FIG. 1B.

Usually, since a picture image has a spatial correlation, a weight for a specific pattern having a lower spatial frequency is large and a weight for a specific pattern having a higher spatial frequency is small. Further, since a specific pattern having a small weight is not an important information for the concerned picture image, therefore, even if such specific pattern is omitted, no large influence is affected onto the picture image and the resultant picture image is rarely deteriorated. Therefore, by making use of this characteristic, amount of information can be compressed.

For example, when applying an orthogonal transformation onto a block consisting of $n_1$ pieces of pixels in line direction and $n_r$ pieces of pixels in row direction, there exist $n_l \times n_r$ pieces of specific patterns in this instance, when it is assumed that a picture image can be reproduced by making use of $N_P$ pieces of specific patterns out of $n_l \times n_r$ pieces of specific patterns, and since one weight information corresponds to one specific pattern, it is understood that the amount of information has been compressed to $N_P/(n_l \times n_r)$.

As shown in FIG. 1A a display device according to the present invention is provided with a display module 1 which displays a picture image 8 (see FIG. 1C) while adding one or a plurality of specific patterns each having different spatial frequencies, a display control unit 2 which controls the display module 1, a computing circuit 3 which generates the specific patterns 6 each having different spatial frequencies based on the picture image for every block while weighting the same differently and a picture image signal generating unit 4 which generates picture image signals. In the display device according to the present invention, since a picture image is formed on the display device by adding weighted specific patterns each having different spatial frequencies, signal clock frequency $f_S$ is decreased which will be explained hereinbelow.

When one block consisting of $n_l \times n_r$ pixels forms one specific pattern, one weighting signal is assigned for the concerned block. Therefore, for a display panel consisting of $n_{0l}$ pieces of pixels in line direction and nor pieces of pixels in row direction $(n_{0l}+n_{0r})/(n_l \times n_r)$ pieces of weighting signals are necessitated. When it is assumed that each of the all blocks requires $N_P$ pieces of specific patterns in order to reproduce a picture image, the display panel requires $N_P \times (n_{0l} \times n_{0r})/(n_l \times n_r)$ pieces of signals for a single picture image. These signals are required for every cycle of $1/f_H$, therefore, the signal clock frequency $f_S$ is expressed by the following equation (3):

$$f_S = N_P \times \frac{n_{0l} \times n_{0r}}{n_l \times n_r} \times f_H = n_{0l} \times n_{0r} \times f_H \times \frac{N_P}{n_l \times n_r} \tag{3}$$

Wherein comparing the above equation (3) with the equation (1), it is noted that the signal clock frequency is reduced by $N_P/(n_l \times n_r)$.

Now, data signal writing time $t_S$ will be discussed. In the present invention since the writing is performed by a block unit consisting of $n_l$ pieces of pixels in line direction and $n_r$ pieces of pixels in row direction, pixels for $n_l$ pieces of lines are collectively scanned. In order to reproduce one picture image such scanning operation is repeated $N_P$ times, therefore, the data signal writing time $t_S$ is expressed by the following equation (4):

$$t_S = \frac{1}{f_H \times n_{0l}} \times \frac{n_l}{N_P} \tag{4}$$

Accordingly, when $n_l > N_P$, the data signal writing time $t_S$ increases. Further, in the present invention, since the pixels for $n_l$ pieces of lines are collectively scanned, a single scan line can be commonly used for a plurality of lines, therefore, an opening rate can be enhanced.

FIGS. 4A through 4H are diagrams for explaining a principle of displaying specific patterns on the pixels according to the present invention. FIGS. 4A through 4H show a case in which two pieces of pixels in line direction and two pieces of pixels in row direction, in that four pixels 14*a*, 14*b*, 14*c* and 14*d* in total are dealt as one block. Each pixel includes a pixel electrode which is constituted by a signal electrode 13*a* connected either to signal line 11*a* or 11*b* and an opposing signal electrode 13*b* connected either to opposing signal line 12*a* or 12*b*.

Figure 4A:
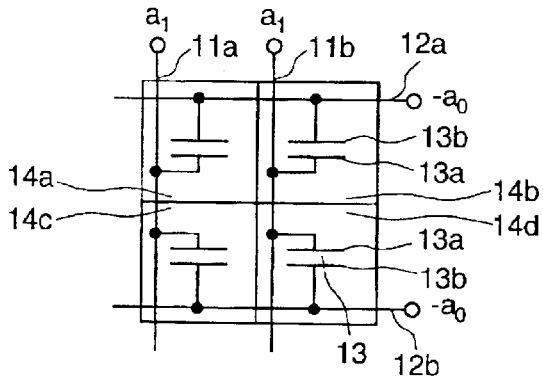
FIGS. 4A through 4H are diagrams for explaining a principle of displaying specific patterns on pixels according to the present invention.
Figure 4B:
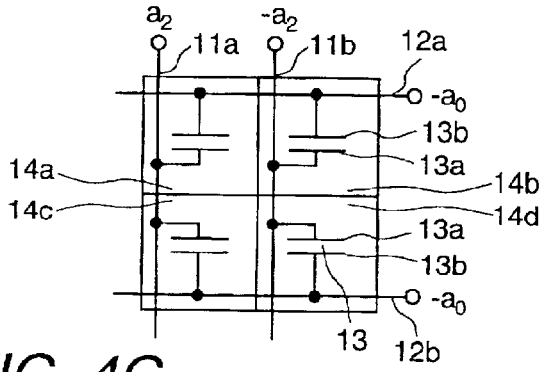
Figure 4C:
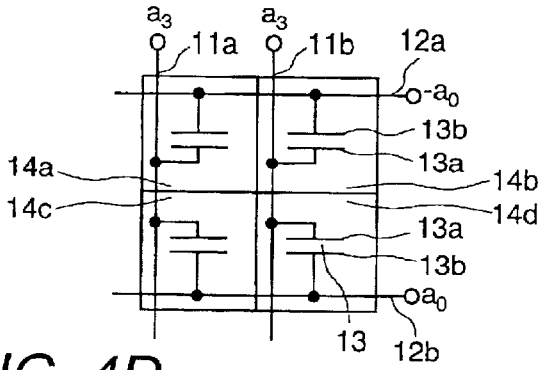
Figure 4D:
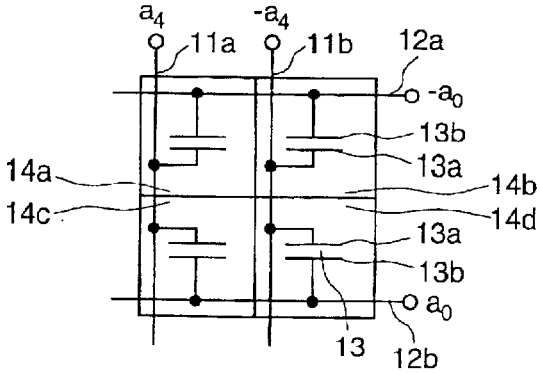
Figure 4E:
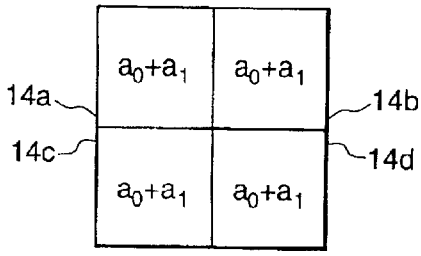

As shown in FIG. 4A, when voltage $a_1$ is respectively applied to the signal lines 11*a* and 11*b* and voltage $-a_0$ is respectively applied to the opposing signal lines 12*a* and 12*b*, voltage having absolute value $a_0+a_1$ are applied to the respective pixel electrodes 13 for the pixels 14*a*, 14*b*, 14*c* and 14*d* as shown in FIG. 4E.

Figure 4F:
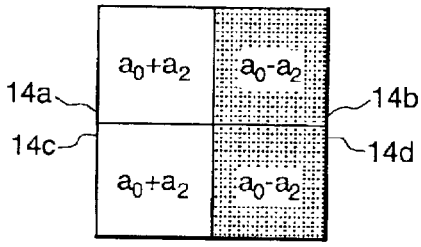

As shown in FIG. 4B, when voltages $a_2$ and $-a_2$ are respectively applied to the signal lines 11*a* and 11*b* and voltage $-a_0$ is respectively applied to the opposing signal lines 12*a* and 12*b*, voltages having absolute value $a_0+a_2$, $a_0-a_2$, $a_0+a_2$ and $a_0-a_2$ are respectively applied to the respective pixel electrodes 13 for the pixels 14*a*, 14*b*, 14*c* and 14*d* as shown in FIG. 4F.

Figure 4G:
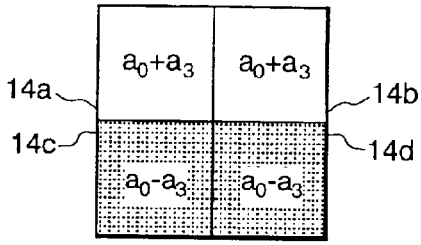

As shown in FIG. 4C, when voltages $a_3$ is respectively applied to the signal lines 11*a* and 11*b* and voltages $-a_0$ and $a_0$ are respectively applied to the opposing signal lines 12*a* and 12*b*, voltages having absolute value $a_0+a_3$, $a_0+a_3$, $a_0-a_3$ and $a_0-a_3$ are respectively applied to the respective pixel electrodes 13 for the pixels 14*a*, 14*b*, 14*c* and 14*d* as shown in FIG. 4G.

Figure 4H:
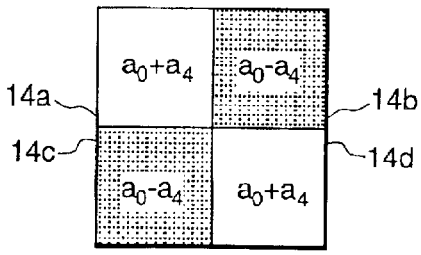

As shown in FIG. 4D, when voltages $a_4$ and $-a_4$ are respectively applied to the signal lines 11*a* and 11*b* and voltages $-a_0$ and $a_0$ are respectively applied to the opposing signal lines 12*a* and 12*b*, voltages having absolute value $a_0+a_4$, $a_0-a_4$, $a_0-a_4$ and $a_0+a_4$ are respectively applied to the respective pixel electrodes 13 for the pixels 14*a*, 14*b*, 14*c* and 14*d* as shown in FIG. 4H.

Herein, when a pixel to which electrode 13 a voltage having an absolute value of $a_0+a_j$ (j=1, 2, 3 and 4) is applied is identified as white color and likely a pixel to which electrode 13 a voltage having another absolute value $a_0-a_j$ (j=1, 2, 3 and 4) is identified as gray color, it is understood that four specific patterns each having different spatial frequencies can be displayed as shown in FIGS. 4E through 4H.

In the present specification, the method of forming such specific patterns will be called, for the sake of convenience, as "specific pattern display method".

Now, a method of generating the specific patterns each having different spatial frequencies with the computing circuit 3 and a method of adding one or a plurality of specific patterns each having different spatial frequencies with the display module 1 both as shown in FIGS. 1A through 1C will be explained with reference to an LC display device, as an example, which uses an LC panel as a display panel.

In the present invention, since a spatial correlation is utilized, a unit block is formed by neighboring pixels. Herein, a unit block formed by 2×2 pixels, in that 2 pieces of pixels in line direction and 2 pieces of pixels in row direction will be explained as shown in FIGS. 4A through 4H.

Figure 5:
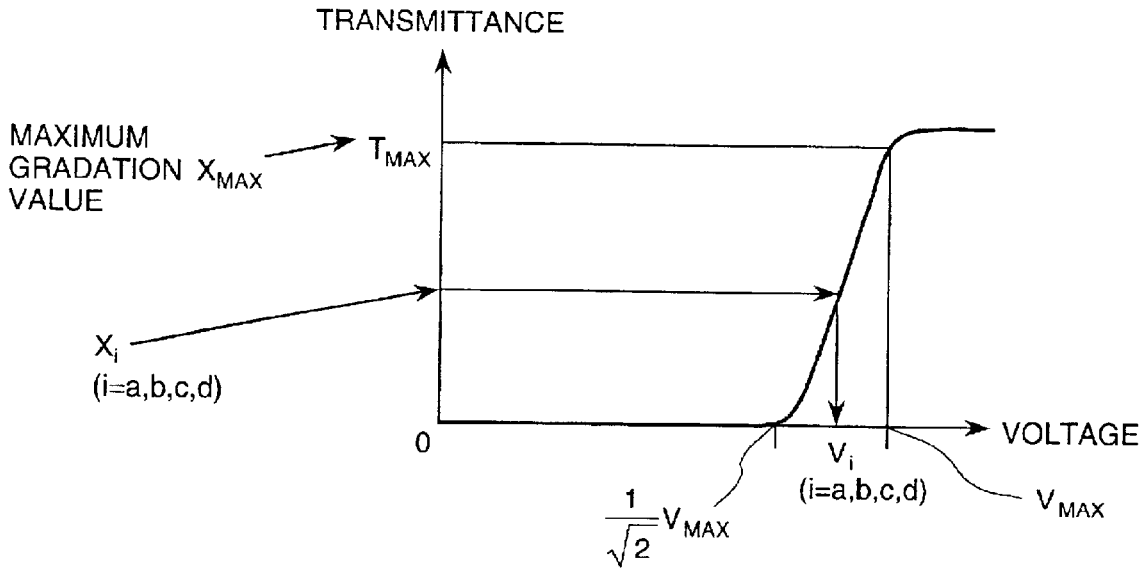
FIG. 5 is a diagram showing a manner for determining voltages Va, Vb, Vc and Vd to be applied on an LC.

FIG. 5 is a diagram showing a manner of determining voltages Va, Vb, Vc and Vd to be applied onto an LC. At first depending on gradation signals $x_a$, $x_b$, $x_c$ and $x_d$ for the pixels 14*a*, 14*b*, 14*c* and 14*d* which are sent from the picture image signal generation unit 4, voltages $V_a$, $V_b$, $V_c$ and $V_d$ to be applied to the respective LCs are determined based on the transmittance-voltage characteristic of LC as shown in FIG. 5. Hereinbelow, the above voltages to be applied to the LCs will be called as "target voltages" for the sake of convenience.

Subsequently, by making use of the "target voltages" weights $a_j$ (j=1, 2, 3 and 4) for respective specific patterns are determined according to the following equation (5) and (6):

$$a_1 = -a_0 + \sqrt{\frac{N_P}{4}\sum_i V_i^2 - 3a_0^2 - \frac{N_P^2}{64a_0^2}\left\{4\sum_i V_i^4 - \left(\sum_i V_i^2\right)^2\right\}} \tag{5}$$

-continued $$a_2 = \frac{N_P}{8a_0}(V_a^2 - V_b^2 + V_c^2 - V_d^2)$$

$$a_3 = \frac{N_P}{8a_0}(V_a^2 + V_b^2 - V_c^2 - V_d^2)$$

$$a_4 = \frac{N_P}{8a_0}(V_a^2 - V_b^2 - V_c^2 + V_d^2)$$

$$a_0 = \sqrt{\frac{N_P}{8}}\, V_{\mathrm{MAX}} \tag{6}$$

Wherein $V_{MAX}$ is the maximum value of the "target voltages" as shown in FIG. 5. For example, an LC panel shows a transmittance-voltage characteristic of normally black as shown in FIG. 5, a voltage which gives a transmittance $T_{MAX}$ corresponding to the maximum value $X_{MAX}$ of gradation signal is $V_{MAX}$. The transmittance $T_{MAX}$ is not necessarily required to the maximum transmittance in the transmittance-voltage characteristic, however, the closer the transmittance $T_{MAX}$ to the maximum transmittance is, the higher brightness is obtained.

The equations (5) are transformations modeled after Hadamard transformation which is one of orthogonal transformations, and the equations can perform weighting for the respective specific patterns each having different spatial frequencies like Hadamard transformation.

The method of determining the weights for the respective specific patterns each having different spatial frequencies as above will be hereinbelow called as "pseudo orthogonal transformation method" for the sake of convenience.

When applying $a_j$ (j=1, 2, 3 and 4) and $a_0$ thus determined according to the "pseudo orthogonal transformation method" in a form of voltage onto the electrodes in the respective pixels through the "specific pattern display method" as has been already explained in connection with FIGS. 4A through 4H, the specific patterns each having different spatial frequencies can be formed as shown in FIGS. 4E through 4H.

Each of the respective specific patterns is assigned to respective subframes divided from one frame, the respective specific patterns are sequentially displayed and added through a field sequential drive method.

More specifically, the specific patterns are added as follows. When all of the four specific patterns are displayed through the field sequential drive method, effective voltages $V'_a$, $V'_b$, $V'_c$ and $V'_d$ for the respective pixels 14*a*, 14*b*, 14*c* and 14*d* are expressed by the following equations (7):

$$V'_a = \frac{1}{\sqrt{N_P}}\sqrt{(a_0+a_1)^2+(a_0+a_2)^2+(a_0+a_3)^2+(a_0+a_4)^2} \tag{7}$$

$$V'_b = \frac{1}{\sqrt{N_P}}\sqrt{(a_0+a_1)^2+(a_0-a_2)^2+(a_0+a_3)^2+(a_0-a_4)^2}$$

$$V'_c = \frac{1}{\sqrt{N_P}}\sqrt{(a_0+a_1)^2+(a_0+a_2)^2+(a_0-a_3)^2+(a_0-a_4)^2}$$

$$V'_d = \frac{1}{\sqrt{N_P}}\sqrt{(a_0+a_1)^2+(a_0-a_2)^2+(a_0-a_3)^2+(a_0+a_4)^2}$$

Wherein, Np=4. When substituting the equations (5) and (6) for the equations (7), it is determined that $V'_a=V_a$, $V'_b=V_b$, $V'_c=V_c$ and $V'_d=V_d$, and voltages equal to the "target voltages" are respectively applied onto the respective pixels 14*a*, 14*b*, 14*c* and 14*d*. Namely, when the respective specific patterns are displayed through the field sequential drive method, the original picture image can be reproduced.

As the result of weighting according to the equations (5), when it is determined that $a_2$ and $a_4$ are sufficiently small in comparison with $a_1$ and $a_3$, if the specific pattern corresponding to $a_2$ (FIG. 4F) and the specific pattern corresponding to $a_4$ (FIG. 4H) are omitted, no large influence is affected on the reproduced picture image.

In such instance, the effective voltages $V'_a$, $V'_b$, $V'_c$ and $V'_d$ for the respective pixels 14*a*, 14*b*, 14*c* and 14*d* when the specific pattern corresponding to $a_2$ and the specific pattern corresponding to $a_4$ are omitted can be expressed by the following equations (8):

$$V'_a = \frac{1}{\sqrt{N_P}}\sqrt{(a_0+a_1)^2+(a_0+a_3)^2} \cong V_a \tag{8}$$

$$V'_b = \frac{1}{\sqrt{N_P}}\sqrt{(a_0+a_1)^2+(a_0+a_3)^2} \cong V_b$$

$$V'_c = \frac{1}{\sqrt{N_P}}\sqrt{(a_0+a_1)^2+(a_0-a_3)^2} \cong V_c$$

$$V'_d = \frac{1}{\sqrt{N_P}}\sqrt{(a_0+a_1)^2+(a_0-a_3)^2} \cong V_d$$

Wherein, $N_P$=2. When the four pixels are displayed by adding the two specific patterns as explained above, the number of signal clocks is reduced into the half thereof.

Herein, although it is exemplified specifically that the specific patterns corresponding to $a_1$ and $a_3$ are displayed through the field sequential method, it is possible to display a picture image near the original picture image if specific patterns each having large weight are displayed through the field sequential method.

Now, if it is conditioned as $a_1>0$ in equations (5) in order to perform a proper weighting, a condition $V_i>V_{MAX}/\sqrt{2}$ (i=a, b, c and d) has to be satisfied which is led through combination of the first equation in equations (5) and the equation (6). Further, a condition $a_0>a_j$ is required in order to form the specific patterns with an LC under which condition a condition $V_i<V_{MAX}$ is required. Accordingly, $V_i$ satisfies the following condition (9):

$$V_{MAX}/\sqrt{2}<V_i<V_{MAX} \tag{9}$$

The method of displaying a picture image as has been explained above, in which the weights of respective specific patterns each having different frequencies are determined for every block through the "pseudo orthogonal transformation method" and the specific patterns having larger weights are displayed through "specific pattern display method" and through the field sequential drive method, will be called hereinbelow as "pseudo orthogonal transformation display method" for the sake of convenience.

With the "pseudo orthogonal transformation display method" the signal clock frequency is reduced and an increase of the data signal writing time is realized, thereby, a display device which permits a highly fine display and a high speed drive can be provided.

Embodiment 1

Figure 6:
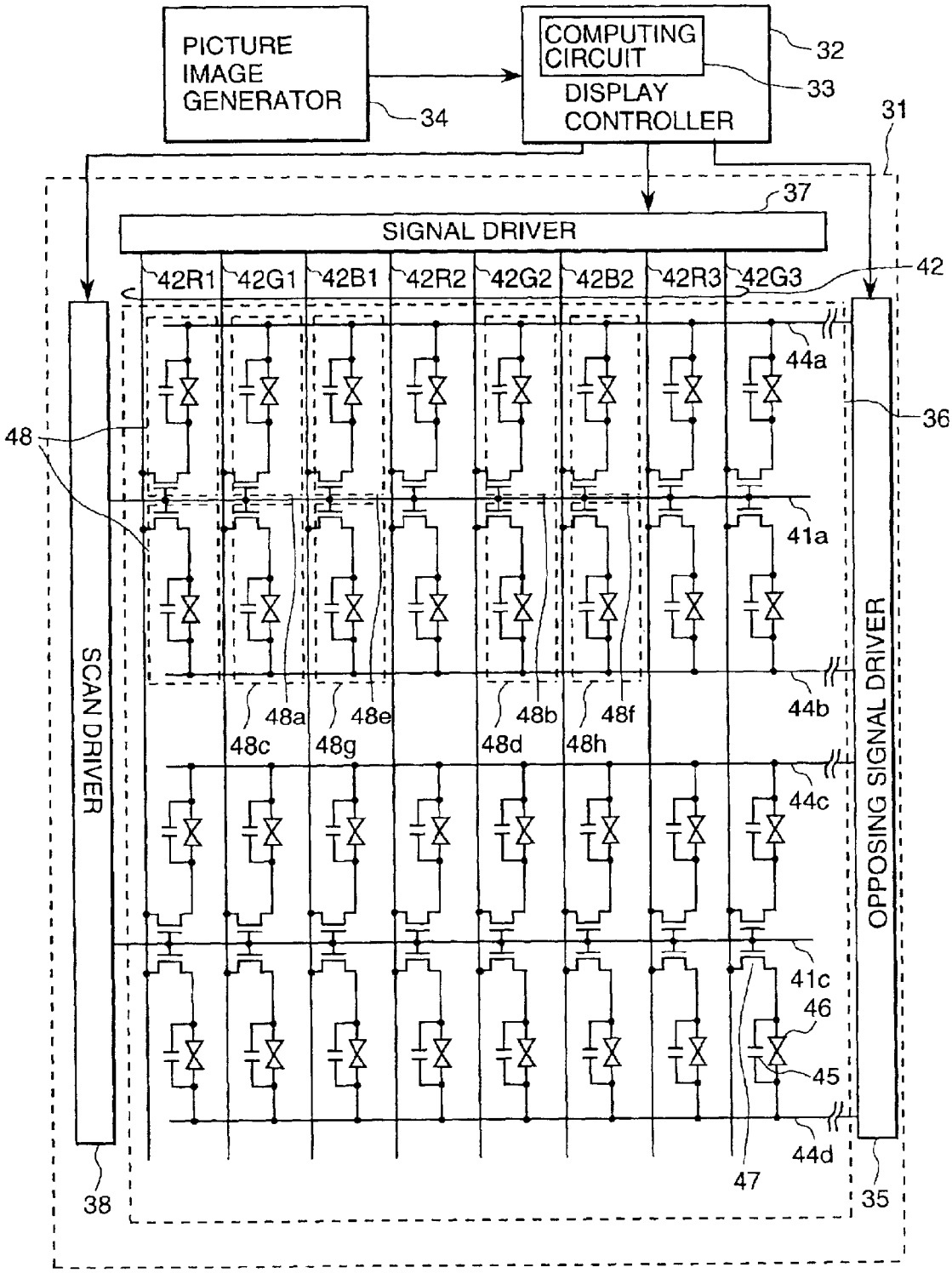
FIG. 6 is a diagram showing a structure of embodiment 1 of a display device according to the present invention.

FIG. 6 is a diagram showing the structure of embodiment 1 of a display unit according to the present invention. The display device of the embodiment 1 is an LC display device which makes use of an LC panel as a display panel 36. As shown in FIG. 6, the LC display device of the embodiment 1 is provided with a display module 31 which determines a plurality of pixels to belong one block unit, selects the plurality of pixels in the block unit at the same time and forms and displays a picture image by adding one or a plurality of specific patterns each having different spatial frequencies, a display control unit 32 which controls the display module 31, a computing circuit 33 which generates the specific patterns each having different spatial frequencies based on picture image signals for every block while weighting the same and a picture image signal generating unit 34 which generates the picture image signals. The display module 31 includes the LC panel 36 in which pixels 48 are arranged in a matrix shape, a signal driver 37, a scan driver 38 and an opposing signal driver 35.

To the signal driver 37 signal lines 42 are connected, to the scan driver 38 scan lines 41*a*, 41*c*, . . . are connected and to the opposing signal driver 35 opposing signal lines 44*a*, 44*b*, 44*c*, 44*d* . . . are connected.

Each of the pixels 48 is provided with a thin film transistor (TFT) 47, a capacitance element 45, and a signal electrode (not shown) and an opposing signal electrode (not shown) which apply a voltage to an LC element 46, the signal electrode is connected to one of the signal lines 42 via the TFT 47 and the opposing signal electrode is connected to one of the opposing signal lines 44*a*, 44*b*, 44*c*, 44*d*, . . . .

Further, a pixel presenting red color (R), a pixel presenting green color (G) and a pixel presenting blue color (B) are successively arranged in this order in the row direction. Namely, the pixels connected to one of the signal lines 42R1, 42R2, 42R3, . . . are R pixels, the pixels connected to one of the signal lines 42G1, 42G2, 42G3, . . . are G pixels and the pixels connected to 42B1, 42B2, 42B3, . . . are B pixels.

Figure 7:
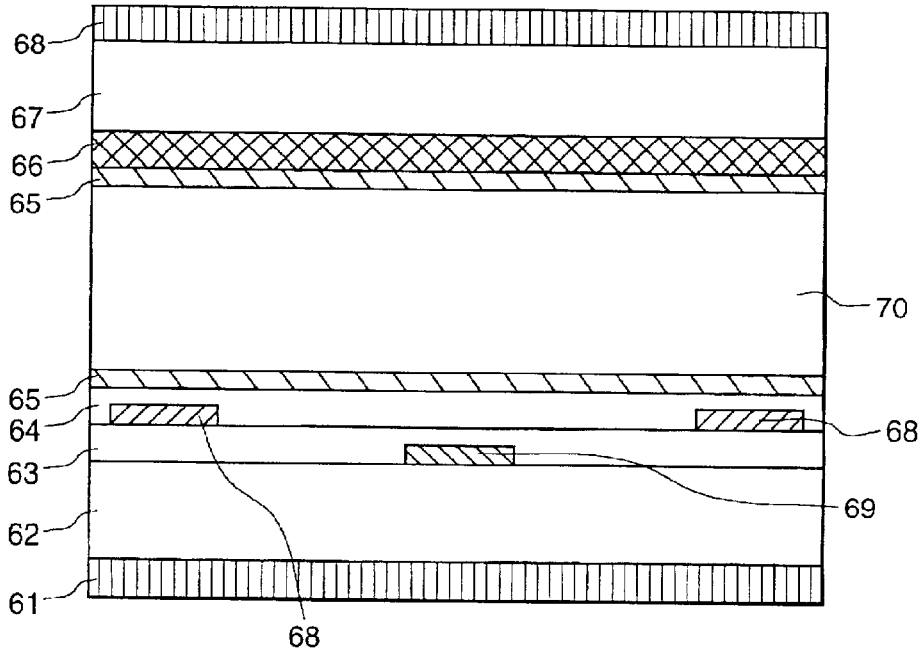
FIG. 7 is a diagram for explaining a structure of an LC panel of the embodiment 1 and showing a cross sectional structure of a pixel portion.

FIG. 7 is a diagram showing a cross sectional structure of a pixel portion for explaining a structure of the LC panel of the present embodiment 1. The LC panel is constituted by a substrate 62 which includes a signal electrode 68, an opposing signal electrode 69, insulating films 63 and 64 and an orientation film 65, another substrate 67 which includes a color filter 66 disposed opposing to the substrate 62 and another orientation film 65, an LC 70 sandwiched between the substrates 62 and 67 and deflection plates 61 which are respectively formed on the surfaces of the substrates 62 and 67 not facing to the LC 70.

A glass substrate having thickness of 0.7 mm was used for the substrates 62 and 67. On the substrate 62 a TFT (not shown) was formed by making use of amorphous silicon. Chromium-molybdenum (CrMo) was used for the signal electrode 68 and the opposing signal electrode 69. The insulating films 63 and 64 are constituted by silicon nitride and of which thickness were respectively determined as 0.2 μm and 0.8 μm. Number of pixels were determined as 1280×3×1024 pieces. The thickness of the orientation film 65 was determined as 80 nm and the surface thereof was applied of a rubbing process so as to orient the LC.

The computing circuit 33 in FIG. 6 executes weighting operation for the respective specific patterns each having different spatial frequencies and selects specific patterns to be added based on the weighting, which will be explained hereinbelow.

Since the present invention utilizes the spatial correlation, it is necessary to process independently the respective R pixels, G pixels and B pixels. Further, for the respective R pixels, G pixels and B pixels respective blocks are formed from their neighboring pixels and the spatial correlation of the neighboring pixels are utilized.

Accordingly, in FIG. 6 one block of 2×2 pixels 2 pieces in line direction and 2 pieces in row direction is formed by pixels 48*a*, 48*b*, 48*c* and 48*d*. Likely, another one block is formed by pixels 48*e*, 48*f*, 48*g* and 48*h*. In the like manner all pixels are dealt by block unit.

For respective blocks weighting of the four specific patterns as shown in FIGS. 4E through 4H is performed through the "pseudo orthogonal transformation method" as has been already explained. Among the four specific patterns three specific patterns are selected as ones to be added.

In this instance, as shown in FIG. 6, all of the pixels on a same line are connected to one of the opposing signal lines 44*a*, 44*b*, 44*c* and 44*d* and all the same voltage is applied to the opposing signal electrodes of the concerned pixels. Accordingly, for example, if voltages $-a_0$ and $-a_0$ are respectively applied to the opposing signal lines 44*a* and 44*b*, the specific patterns which can be displayed by the blocks including two pixel lines each connected to the opposing signal lines 44*a* and 44*b* are only ones of FIGS. 4E and 4F.

Likely, when voltages $-a_0$ and $a_0$ are respectively applied to the opposing signal lines 44*a* and 44*b*, the specific patterns which can be displayed are only ones of FIGS. 4G and 4H. Accordingly, the specific patterns of FIG. 4E or 4F and the specific patterns of FIG. 4G or 4H can not be displayed at the same time for the blocks including the same two pixel lines.

For this reason, when selecting three specific patterns out of the four specific patterns, the three specific patters as shown in FIGS. 4E through 4G are selected other than the specific pattern as shown in FIG. 4H having the highest spatial frequency of which weight shows minimum with regard to most of the blocks.

The selected three specific patterns are controlled by the display control unit 32 as shown in FIG. 6, and are displayed on the LC panel 36 provided in the display module 31 through the field sequential drive method.

For example, it is assumed that the weights of the specific patterns as shown in FIGS. 4E through 4G are respectively $a'_1$, $a'_2$ and $a'_3$ for the block constituted by the pixels 48*a*, 48*b*, 48*c* and 48*d*, and are respectively $a''_1$, $a''_2$ and $a''_3$ for the block constituted by the pixels 48*e*, 48*f*, 48*g* and 48*h*.

When an address signal is given to the scan line 41*a* in FIG. 6 and two pixel lines including the block constituted by the pixels 48*a*, 48*b*, 48*c* and 48*d* are selected, and when voltages $a'_1$, and $a'_1$ are respectively applied to the signal lines 42G1 and 42G2, voltages $a''_1$ and $a''_1$ are respectively applied to the signal lines 42B1 and 42B2 and voltages $-a_0$ and $-a_0$ and voltages $-a_0$ and $-a_0$ are respectively applied to the opposing signal lines 44*a* and 44*b*, all of the voltages applied to the LCs for the pixels 48*a*, 48*b*, 48*c* and 48*d* are $a_0+a'_1$, thereby, the block constituted by the above four pixels forms the specific pattern as shown in FIG. 4E, and all of the voltages applied to the LCs for the pixels 48*e*, 48*f*, 48*g* and 48*h* are $a_0+a''_1$, thereby, the block constituted by the above four pixels forms the specific pattern as shown in FIG. 4E.

Likely, all of the blocks selected by the scan line 41*a* form a specific pattern either one shown in FIG. 4E or one shown in FIG. 4F.

Subsequently, when an address signal is given to the scan line 41*c*, the blocks including the selected two pixel lines likely forms the specific patterns.

Such scanning is proceeded in the same manner.

After completing scanning for all of the scan lines once, and when an address signal is again given to the scan line 41*a* and two pixel lines including the block constituted by the pixels 48*a*, 48*b*, 48*c* and 48*d* are selected, and when voltages $a'_2$ and $-a'_2$ are respectively applied to the signal lines 42G1 and 42G2, voltages $a''_2$ and $-a''_2$ are respectively applied to the signal lines 42B1 and 42B2 and voltages $-a_0$ and $-a_0$ are respectively applied to the opposing signal lines 44*a* and 44*b*, the voltages applied to the LCs for the pixels 48*a*, 48*b*, 48*c* and 48*d* are respectively $a_0+a'_2$, $a_0-a'_2$, $a_0+a'_2$ and $a_0-a'_2$, thereby, the block constituted by the above four pixels forms the specific pattern as shown in FIG. 4F, and the voltages applied to the LCs for the pixels 48*e*, 48*f*, 48*g* and 48*h* are respectively $a_0+a''_2$, $a_0-a''_2$, $a_0+a''_2$ and $a_0-a''_2$, thereby, the block constituted by the above four pixels forms the specific pattern as shown in FIG. 4F.

Likely, after completing scanning of all of the scan lines and an address signal is again given to the scan line 41*a*, and when predetermined signal voltages are applied to the respective signal lines and the opposing signal lines, the selected block forms a specific pattern as shown in FIG. 4G in the same manner as above.

Through the application of the voltages for forming the specific patterns for respective blocks according to the "specific patterns display method" and through combination thereof with the field sequential drive method as has been explained above, the effective signal voltages are approximated to the "target voltages" and a picture image substantially the same as that generated by the picture image signal generation unit can be displayed.

In this instance, since the display is effected by adding the three specific patterns for the four pixels, the signal clock frequency can be reduced to ¾ in comparison with the instance of the line sequential scan driving method as explained in connection with FIG. 3 which will be understood through comparison of equations (1) and equations (3).

Further, since one scan line is used in common by two pixel lines, the opening rate is also enhanced in comparison with the instance of the line sequential scan driving method as explained in connection with FIG. 3.

Embodiment 2

Figure 8:
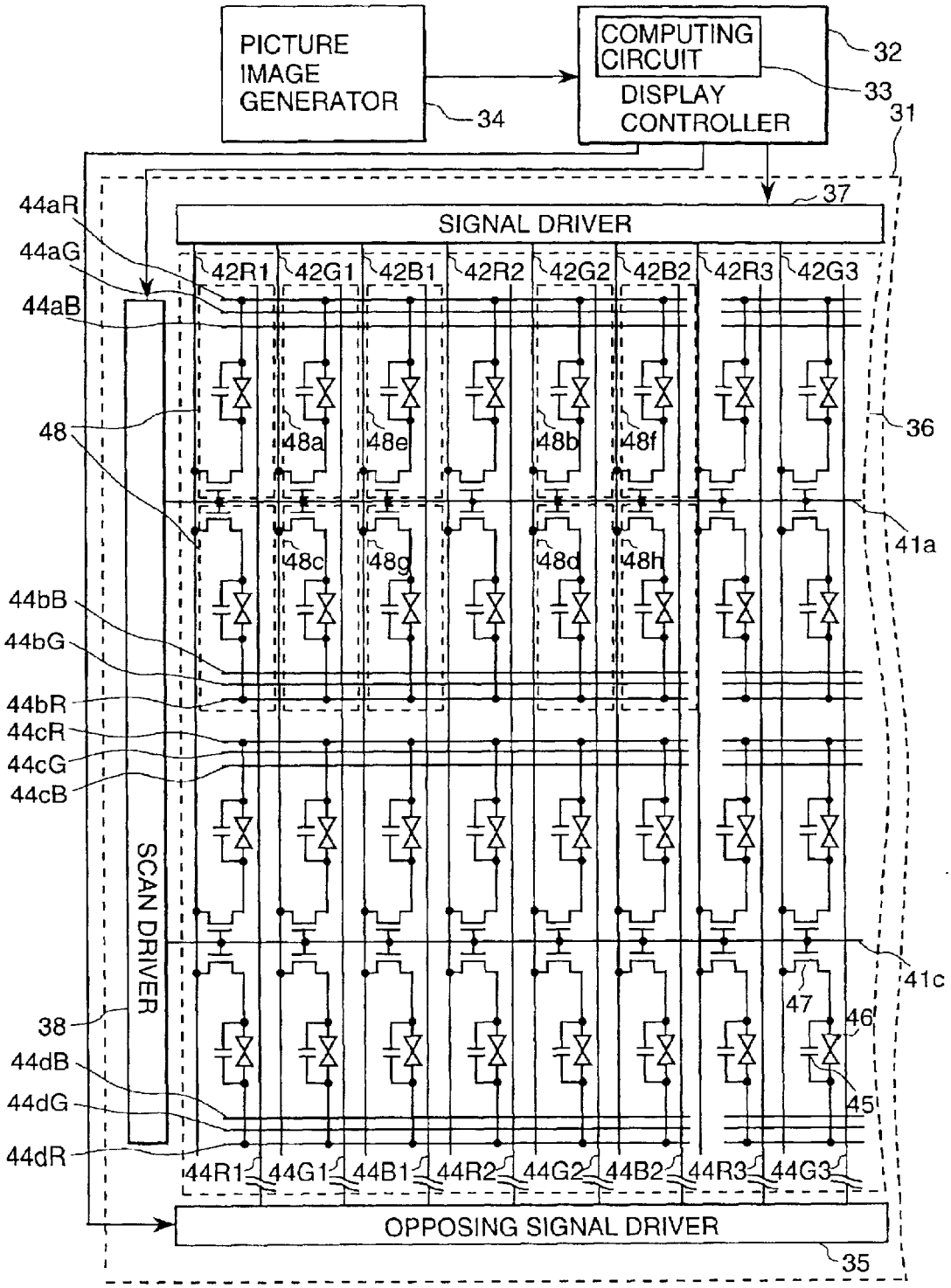
FIG. 8 is a diagram showing a structure of embodiment 2 of a display device according to the present invention.

FIG. 8 is a diagram showing the structure of embodiment 2 of a display unit according to the present invention. The display device of the embodiment 2 is an LC display device which makes use of an LC panel as a display panel 36. As shown in FIG. 8, the LC display device of the embodiment 2 is provided with an LC panel 36 in which pixels 48 are arranged in a matrix shape, a signal driver 37, a scan driver 38 and an opposing signal driver 35, and is further provide with a display module 31 which determines a plurality of pixels to belong one block unit, selects the plurality of pixels in the block unit at the same time and forms and displays a picture image by adding one or a plurality of specific patterns each having different spatial frequencies, a display control unit 32 which controls the display module 31, a computing circuit 33 which generates the specific patterns each having different spatial frequencies based on picture image signals for every block while weighting the same and a picture image signal generating unit 34 which generates the picture image signals.

To the signal driver 37 signal lines 42R1, 42G1, 42B1, 42R2 . . . are connected, to the scan driver 38 scan lines 41*a*, 41*c*, . . . are connected and to the opposing signal driver 35 opposing signal common lines 44R1, 44G1, 44B1, 44R2 . . . are connected.

Each of the pixels 48 is provided with a TFT 47, a capacitance element 45, and a signal electrode (not shown) and an opposing signal electrode (not shown) which apply a voltage to an LC element 46, the signal electrode is connected to one of the signal lines 42R1, 42G1, 42B1, 42R2 . . . via the TFT 47 and the opposing signal electrode is connected one of the opposing signal lines 44$a$R, 44$a$G, 44$a$B, 44$b$R, 44$b$G, 44$b$B, 44$c$R, . . . .

The opposing signal lines 44$a$R, 44$a$G, 44$a$B, 44$b$R, 44$b$G, 44$b$B, 44$c$R, . . . are respectively connected to one of the opposing signal common lines 44R1, 44G1, 44B1, 44R2, . . . .

Further, an R pixel, a G pixel and a B pixel are successively arranged in this order in the row direction.

Since the present invention utilizes the spatial correlation, it is necessary to process independently the respective R pixels, G pixels and B pixels. Further, for the respective R pixels, G pixels and B pixels respective blocks are formed from their neighboring pixels.

Accordingly, one block of 2×2 pixels is formed by pixels 48$a$, 48$b$, 48$c$ and 48$d$. Likely, another one block is formed by pixels 48$e$, 48$f$, 48$g$ and 48$h$. In the like manner all pixels are dealt by block unit.

In the present embodiment, only the LC for the pixel 48$a$ and the LC for the pixel 48$b$ which belong to a same line and a same block are connected to the common opposing signal line 44$a$G. Namely, the opposing signal lines are arranged independently for every block.

On this point, the embodiment 2 is greatly different from the embodiment 1 in which a common opposing signal line is arranged for all of the pixels on the same pixel line.

Since the cross sectional structure of the pixel portion of the present embodiment 2 is substantially the same as that of the embodiment 1 as shown in FIG. 7, the explanation thereof is omitted here.

The computing circuit 33 in FIG. 8 executes weighting operation for the respective specific patterns each having different spatial frequencies and selects specific patterns to be added based on the weighting, which will be explained hereinbelow.

For respective blocks weighting of the four specific patterns as shown in FIGS. 4E through 4H is performed through the "pseudo orthogonal transformation method" as has been already explained. Among the four specific patterns two specific patterns are selected as ones to be added.

Different from the embodiment 1, in the present embodiment 2, since the opposing signal lines are not prepared for every block, all of the specific patterns as shown in FIGS. 4E through 4H can be displayed at the same time on the blocks including a same pixel lines.

For this reason, with the embodiment 2 a picture image comparable to that obtained by the embodiment 1 in which three specific patterns are selected, can be obtained by adding only two specific patterns.

The selected two specific patterns are controlled by the display control unit 32 as shown in FIG. 8, and are displayed on the LC panel 36 provided in the display module 31 through the field sequential drive method.

Since the present drive and display method is the same as that of the embodiment 1, the method will be explained simply with reference to an example thereof. For example, it is assumed that the weights of the specific patterns as shown in FIGS. 4E through 4F for the block constituted by the pixels 48$a$, 48$b$, 48$c$ and 48$d$, are larger than those of the other two specific patterns and are respectively to be $a'_1$ and $a'_2$.

When an address signal is given to the scan line 41$a$ in FIG. 8 and two pixel lines including the block constituted by the pixels 48$a$, 48$b$, 48$c$ and 48$d$ are selected, and when voltages $a'_1$ and $a'_1$ are respectively applied to the signal lines 42G1 and 42G2, and voltages $-a_0$ and $-a_0$ are respectively applied to the opposing signal common lines 44G1 and 44G2, all of the voltages applied to the LCs for the pixels 48$a$, 48$b$, 48$c$ and 48$d$ are $a_0+a'_1$, thereby, the block constituted by the above four pixels forms the specific pattern as shown in FIG. 4E.

Likely, all of the blocks selected by the scan line 41$a$ form one of the specific patterns as shown in FIG. 4E through FIG. 4H.

Likely, after completing scanning of all of the scan lines and an address signal is again given to the scan line 41$a$, and when predetermined signal voltages are applied to the respective signal lines and the opposing signal lines, the voltages $a_0+a'_2$, $a_0-a'_2$, $a_0+a'_2$ and $a_0-a'_2$ are respectively applied to the LCs for the pixels 48$a$, 48$b$, 48$c$ and 48$d$ and the block constituted by the four pixels forms specific pattern as shown in FIG. 4F in the same manner as above.

Through the application of the voltages for forming the specific patterns for respective blocks according to the "specific patterns display method" and through combination thereof with the field sequential drive method as has been explained above, the effective signal voltages are approximated to the "target voltages" and a picture image substantially the same as that generated by the picture image signal generation unit can be displayed.

In this instance, since the display is effected by adding the two specific patterns for the four pixels, the signal clock frequency can be reduced to ½ in comparison with the instance of the line sequential scan driving method as explained in connection with FIG. 3 which will be understood through comparison of equations (1) and equations (3).

Further, in the present embodiment 2, 2×2 pixels are dealt as one block, however, one block can be constituted by such as 4×4 pixels and 8×8 pixels without substantially changing fundamental idea of the present invention.

For example, when assuming 4×4 pixels as one block, 16 pieces of specific patterns are generated and in such instance when about 8 specific patterns out of the 16 specific patterns are selected and used, a picture image with no quality deterioration can be displayed.

In this instance, since the display is effected by adding 8 pieces of specific patterns for the 16 pieces of pixels, the signal clock frequency is likely reduced to ½ in comparison with the line sequential scanning and driving method.

Embodiment 3

Figure 9:
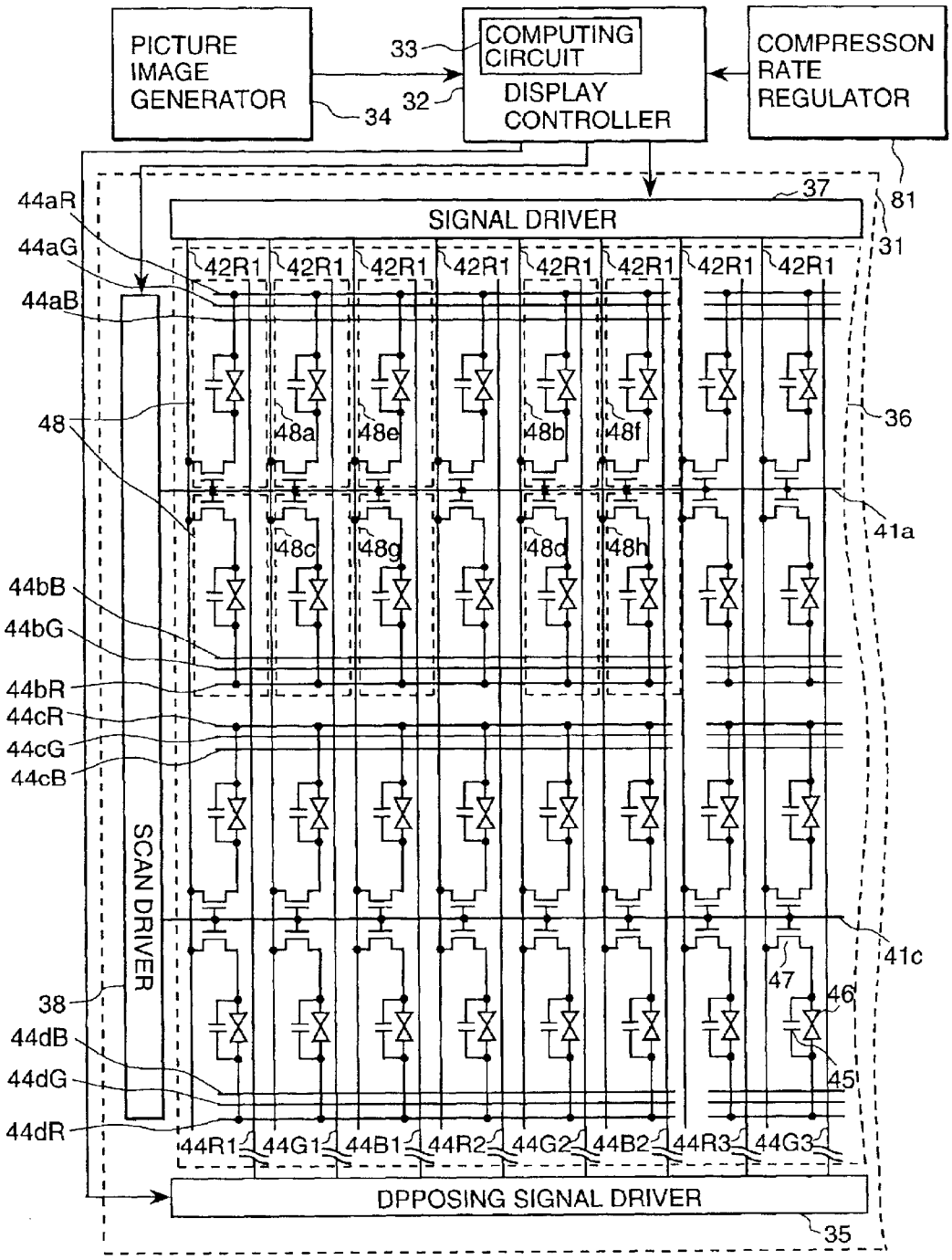
FIG. 9 is a diagram showing a structure of embodiment 3 of a display device according to the present invention.

FIG. 9 is a diagram showing a structure of embodiment 3 of a display device according to the present invention. As shown in FIG. 9 the present embodiment 3 is substantially the same except for an addition of a compression rate regulation unit 81.

Accordingly, the function of the compression rate regulation unit 81 will be explained hereinbelow.

In the embodiment 2, the number $N_P$ of the specific patterns to be added was fixed at 2, however, the compression rate regulation unit 81 according to the present embodiment 3 has a function of varying the number $N_P$ of the specific patterns to be added.

For example, it is assumed that the relationship between the weights of the specific patterns for a certain block is $a_1>a_3>a_2>a_4$ in the "pseudo orthogonal transformation method". Herein, when $N_P=3$, one frame is divided into three subframes and the respective specific patterns corresponding to weights $a_1$, $a_3$ and $a_2$ are sequentially displayed. Further, when $N_P=1$, only the pattern corresponding to weight al is displayed in one frame.

Since the number of subframes varies depending on the number $N_P$ of the specific patterns to be added, the scan driver 38 functions to regulate the scanning frequency depending on the variation thereof.

For example, when the number $N_P$ of the specific patterns to be added increases, the number of subframes increases, therefore, it is necessary to increase the scanning frequency.

Further, as will be apparent from the equation (6), the voltage $a_0$ applied to the opposing signal lines 44*a*R, 44*a*G, 44*a*B, 44*b*R, 44*b*G, 44*b*B, 44*c*R, . . . varies depending on the number $N_P$ of the specific patterns, the opposing signal driver 35 functions to regulate the voltage $a_0$ depending thereon.

As has been explained above, since the number Np of the specific patterns to be added can be variably changed by the compression rate regulation unit 81, the present embodiment 3 can provide an LC display device which permits selection by a user between a low signal clock frequency mode having a small $N_P$, in that a low electric power consumption mode and a high picture image quality mode having a large $N_P$.

Embodiment 4

Figure 10:
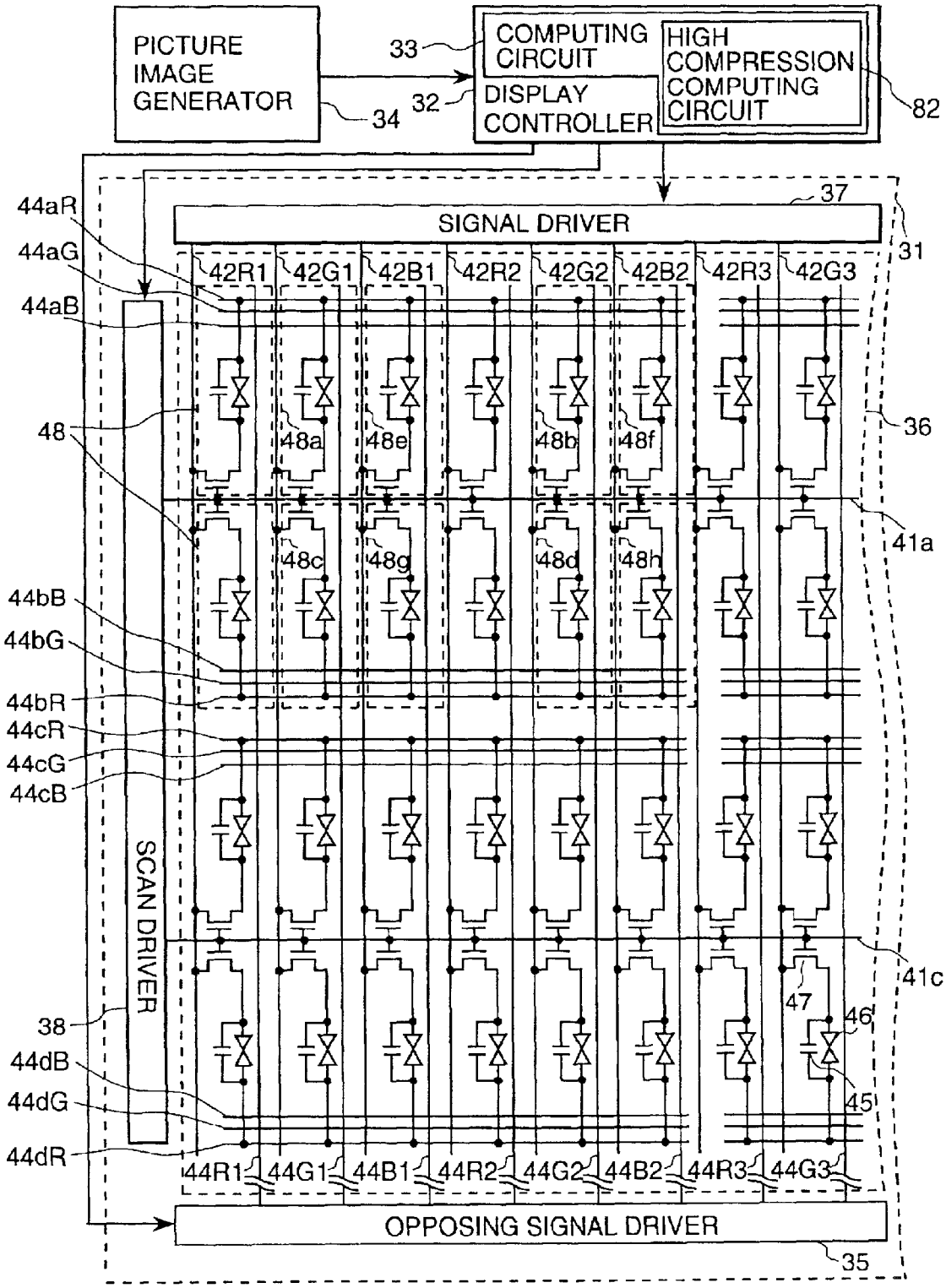
FIG. 10 is a diagram showing a structure of embodiment 4 of a display device according to the present invention.

FIG. 10 is a diagram showing a structure of embodiment 4 of a display device according to the present invention. As shown in FIG. 10, the present embodiment 4 is substantially the same as the embodiment 2 except that a high compression computing circuit 82 is added in the computing circuit 33.

Now, the function of the high compression computing circuit 82 will be explained. Since human eyes are not sensitive with regard to resolution of blue color in comparison with resolution of such as red color and green color, if the kinds of specific patterns to be added for B pixels are reduced smaller than the kinds of specific patterns to be added for such as R pixels and G pixels, the deterioration of the picture quality is hardly sensed.

For this reason, for the block constituted by such as R pixels and G pixels two kinds of specific pattern are displayed, on the other hand, for the blocks constituted by B pixels only one specific pattern as shown in FIG. 4E is displayed.

With this measure, for the blocks constituted by B pixels, it is enough if only the weight $a_1$ in the equations (5) for the "pseudo orthogonal transformation method" is determined, which simplifies the computation. The high compression computing circuit 82 performs the above computation and reduces the load of the computing circuit 33.

However, in the present embodiment it is impossible to vary the number $N_P$ of specific patterns to be added in block by block. Because, although the number of subframes can be varied depending on $N_P$ with regard to the blocks containing a same pixel line, since their scan lines 41*a*, 41*c*, . . . are common, therefore, the scanning frequency can not be varied in block by block.

For this reason, in accordance with the number $N_P$ of the specific patterns to be added for the blocks constituted by either R pixels or G pixels, the specific pattern as shown in FIG. 4E is displayed twice for the blocks constituted by B pixels.

As has been explained above, when the high compression computing circuit 82 is provided which can vary the kind number of the specific patterns to be added depending on blocks, the display of only one specific pattern as shown in FIG. 4E is permitted for the blocks constituted by B pixels, which reduces the load of the computing circuit 33.

Embodiment 5

Figure 11:
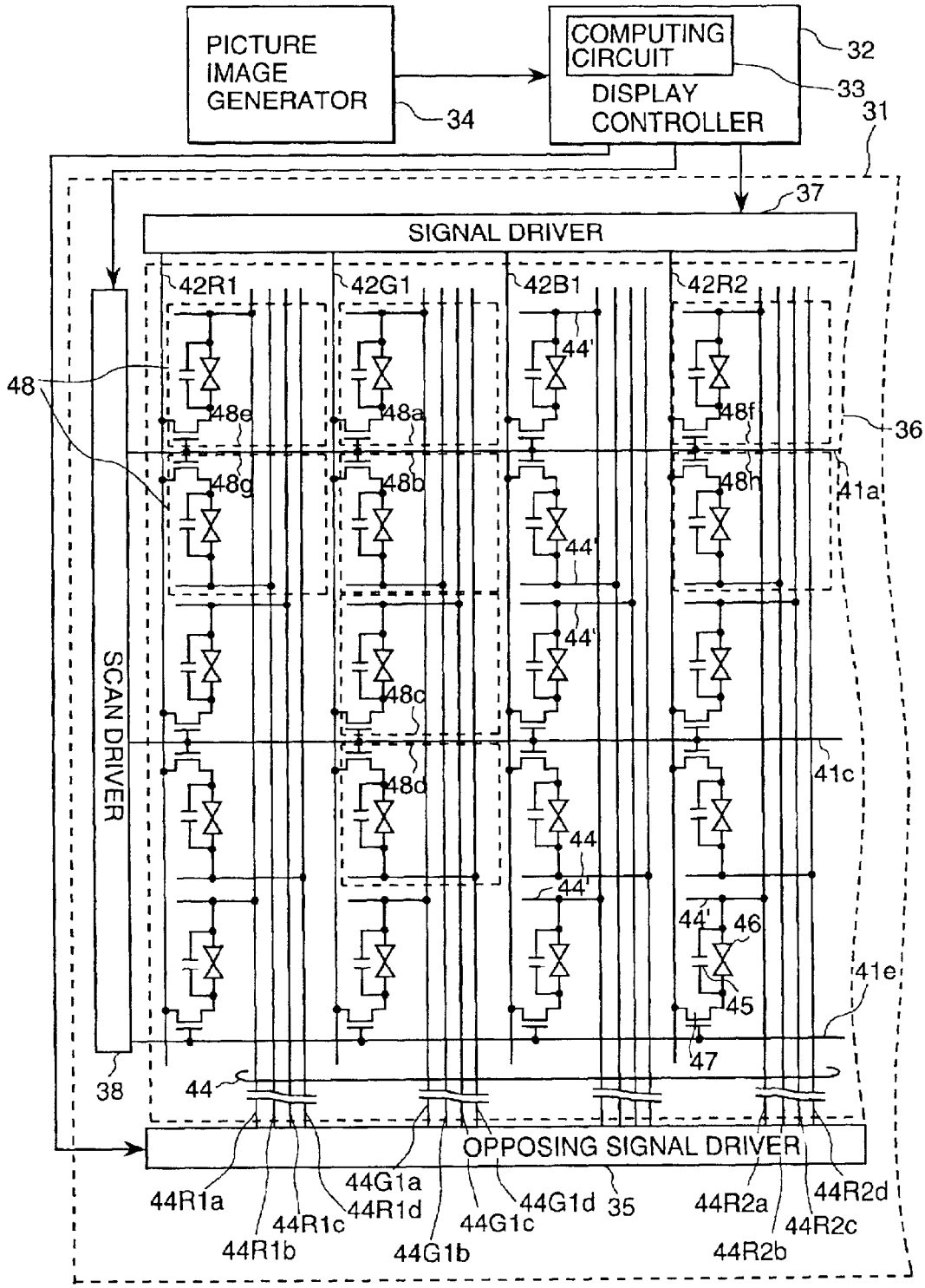
FIG. 11 is a diagram showing a structure of embodiment 5 of a display device according to the present invention.

FIG. 11 is a diagram showing the structure of embodiment 5 of a display unit according to the present invention. The display device of the embodiment 5 is an LC display device which makes use of an LC panel as a display panel 36. As shown in FIG. 11, the LC display device of the embodiment 5 is provided with the LC panel 36 in which pixels 48 are arranged in a matrix shape, a signal driver 37, a scan driver 38 and an opposing signal driver 35 and is further provided with a display module 31 which determines a plurality of pixels to belong one block unit, selects the plurality of pixels in the block unit at the same time and forms and displays a picture image by adding one or a plurality of specific patterns each having different spatial frequencies, a display control unit 32 which controls the display module 31, a computing circuit 33 which generates the specific patterns each having different spatial frequencies based on picture image signals for every block while weighting the same and a picture image signal generating unit 34 which generates the picture image signals.

To the signal driver 37 signal lines 42R1, 42G1, 42B1, 42R2 . . . are connected, to the scan driver 38 scan lines 41*a*, 41*c*, 41*e*, . . . are connected and to the opposing signal driver 35 opposing signal lines 44, are connected.

Each of the pixels 48 is provided with a TFT 47, a capacitance element 45, and a signal electrode (not shown) and an opposing signal electrode (not shown) which apply a voltage to an LC element 46, the signal electrode is connected to one of the signal lines 42R1, 42G1, 42B1, 42R2 . . . via the TFT 47 and the opposing signal electrode is connected to one of the opposing signal lines.

The opposing signal lines 44', . . . are respectively connected to one of the opposing signal common lines 44, . . . .

Further, an R pixel, a G pixel and a B pixel are successively arranged in this order in the row direction.

Since the present invention utilizes the spatial correlation, it is necessary to process independently the respective R pixels, G pixels and B pixels. Further, for the respective R pixels, G pixels and B pixels respective blocks are formed from their neighboring pixels.

In the present embodiment 5, for example, like the block constituted by the pixels 48*a*, 48*b*, 48*c* and 48*d* one block is constituted by 4×1 pixels, in that 4 pieces of pixels in line direction and 1 pixel in row direction. Therefore, the structure of the unit block of the embodiment 5 is different from that of the unit block of 2×2 pixels in the embodiment 2.

To the respective pixels in the unit block of 4×1 pixels respectively independent opposing signal lines 44' are arranged, and to the respective opposing signal lines 44' respectively independent opposing signal common lines 44 are connected, thereby, respectively independent opposing signal voltages can be applied to the respective pixels.

Since the cross sectional structure of the pixel portion of the present embodiment 5 is substantially the same as that of the embodiment 1 as shown in FIG. 7, the explanation thereof is omitted here.

FIGS. 12A through 12H are diagrams for explaining a principle of displaying specific patterns by the unit block of 4×1 pixels. FIGS. 12A through 12H shows an instance wherein total four pixels 14*a*, 14*b*, 14*c* and 14*d* in 4 pieces of pixel in line direction and 1 pieces of pixel in row direction are dealt to belong one unit block.

Each of the pixels includes a pixel electrode 13 which is constituted by a signal electrode 13*a* connected to a signal line 11 and an opposing signal electrode 13*b* connected to one of opposing signal lines 12*a*, 12*b*, 12*c* and 12*d*.

Figure 12A:
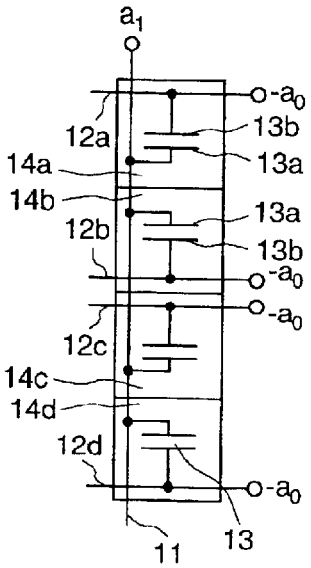
FIG. 12A through 12H are diagrams for explaining a principle of displaying specific patterns in a 4×1 block unit according to the present invention.
Figure 12B:
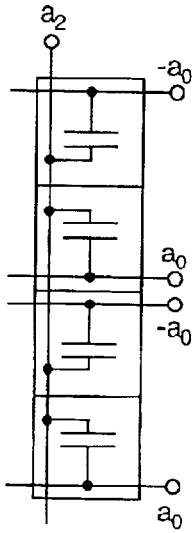
Figure 12C:
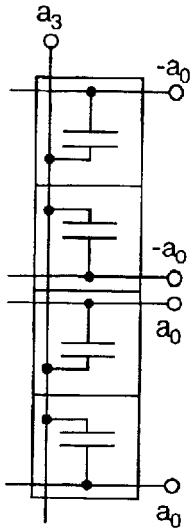
Figure 12D:
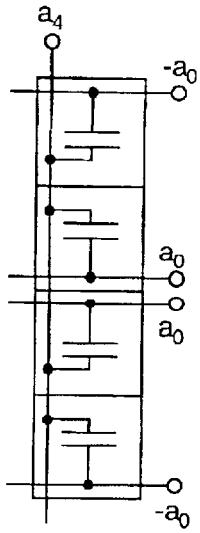
Figure 12E:
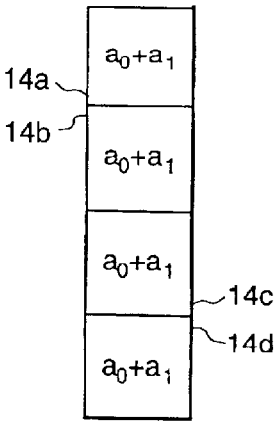

As shown in FIG. 12A, when voltage $a_1$ is applied to the signal line 11 and voltage $-a_0$ is applied to the opposing signal lines 12*a*, 12*b*, 12*c* and 12*d*, a voltage having absolute value of $a_0+a_1$ is applied to the respective pixel electrodes 13 for the pixels 14*a*, 14*b*, 14*c* and 14*d* as shown in FIG. 12E.

Figure 12F:
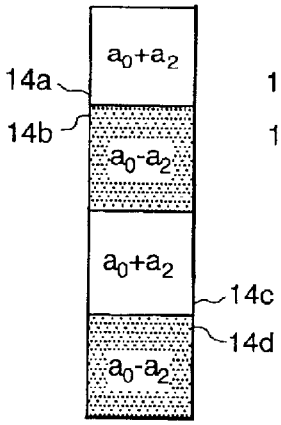

As shown in FIG. 12B, when voltage $a_2$ is applied to the signal line 11 and voltages $-a_0$, $a_0$, $-a_0$, $a_0$ are applied to the opposing signal lines 12*a*, 12*b*, 12*c* and 12*d*, voltages having absolute value of $a_0+a_2$, $a_0-a_2$, $a_0+a_2$, $a_0-a_2$ are applied to the respective pixel electrodes 13 for the pixels 14*a*, 14*b*, 14*c* and 14*d* as shown in FIG. 12F.

Figure 12G:
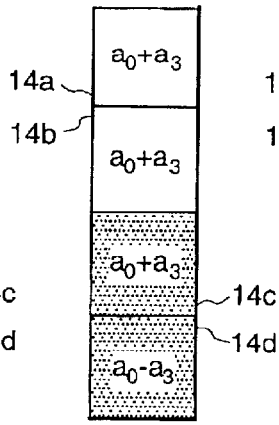

As shown in FIG. 12C, when voltage $a_3$ is applied to the signal line 11 and voltages $-a_0$, $-a_0$, $a_0$, $a_0$ are applied to the opposing signal lines 12*a*, 12*b*, 12*c* and 12*d*, voltages having absolute value of $a_0+a_3$, $a_0+a_3$, $a_0-a_3$, $a_0-a_3$ are applied to the respective pixel electrodes 13 for the pixels 14*a*, 14*b*, 14*c* and 14*d* as shown in FIG. 12G.

Figure 12H:
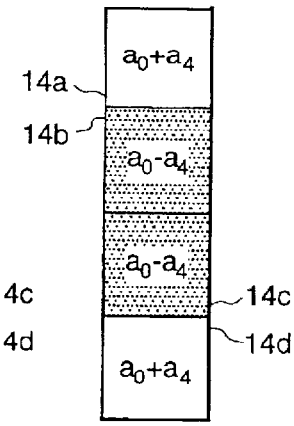

As shown in FIG. 12D, when voltage $a_4$ is applied to the signal line 11 and voltages $-a_0$, $a_0$, $a_0$, $-a_0$ are applied to the opposing signal lines 12*a*, 12*b*, 12*c* and 12*d*, voltages having absolute value of $a_0+a_4$, $a_0-a_4$, $a_0-a_4$, $a_0+a_4$ are applied to the respective pixel electrodes 13 for the pixels 14*a*, 14*b*, 14*c* and 14*d* as shown in FIG. 12H.

Herein, when a pixel to which electrode 13 a voltage having an absolute value of $a_0+a_j$ (j=1, 2, 3 and 4) is applied is identified as white color and likely a pixel to which electrode 13 a voltage having another absolute value $a_0-a_j$ (j=1, 2, 3 and 4) is identified as gray color, it is understood that four specific patterns each having different spatial frequencies can be displayed as shown in FIGS. 12E through 12H.

The computing circuit 33 in FIG. 11 executes weighting operation for the respective specific patterns each having different spatial frequencies and selects specific patterns to be added based on the weighting, which will be explained hereinbelow.

For respective blocks weighting of the four specific patterns as shown in FIGS. 12E through 12H is performed through the "pseudo orthogonal transformation method" as has been already explained.

Among the four specific patterns three specific patterns are selected as ones to be added. The selected three specific patterns are controlled by the display control unit 32 as shown in FIG. 11 and are displayed on the LC panel 36 provided in the display module 31 through the field sequential drive method. Since the present drive and display method is the same as that of the embodiment 1, the method will be explained simply with reference to an example thereof. For example, it is assumed that the weights of the specific patterns as shown in FIGS. 12E, 12G and 12H for the block constituted by the pixels 48*a*, 48*b*, 48*c* and 48*d*, are larger than those of the other specific pattern and are respectively to be $a'_1$, $a'_3$ and $a'_4$.

When an address signal is given at the same time to the two scan lines 41*a* and 41*c* in FIG. 11 and four pixel lines including the block constituted by the pixels 48*a*, 48*b*, 48*c* and 48*d* are selected, and when voltage $a'_1$ is applied to the signal line 42G1 and voltages $-a_0$, $-a_0$, $-a_0$, $-a_0$ are respectively applied to the opposing signal common lines 44G1*a*, 44G1*b*, 44G1*c* and 44G1*d*, all of the voltages applied to the LCs for the pixels 48*a*, 48*b*, 48*c* and 48*d* are $a_0+a'_1$, thereby, the block constituted by the above four pixels forms the specific pattern as shown in FIG. 12E.

Likely, all of the blocks selected by the scan lines 41*a* and 41*c* form one of the specific patterns as shown in FIG. 12E through FIG. 12H.

Likely, after completing scanning of all of the scan lines and an address signal is again given to the scan lines 41*a* and 41*c*, and when predetermined signal voltages are applied to the respective signal lines and the opposing signal lines, the voltages $a_0+a'_3$, $a_0+a'_3$, $a_0-a'_3$ and $a_0-a'_3$ are respectively applied to the LCS for the pixels 48*a*, 48*b*, 48*c* and 48*d* and the block constituted by the four pixels forms the specific pattern as shown in FIG. 12G in the same manner as above.

In the like manner, after completing scanning of all of the scan lines and when an address signal is again given to the scan lines 41*a* and 41*c*, the specific pattern as shown in FIG. 12H is formed.

Through the application of the voltages for forming the specific patterns for respective blocks according to the "specific patterns display method" and through combination thereof with the field sequential drive method as has been explained above, the effective signal voltages are approximated to the "target voltages" and a picture image substantially the same as that generated by the picture image signal generation unit can be displayed.

In this instance, since the display is effected by adding the three specific patterns for the four pixels, the signal clock frequency can be reduced to ¾ in comparison with the instance of the line sequential scan driving method as shown in FIG. 3 which will be understood through comparison of equations (1) and equations (3).

In the present embodiment, since four pixel lines are collectively scanned and the display is performed with three subframes, the data signal writing time can be increased to ⅔ times which will be understood from comparison between equations (2) and (4).

As will be apparent from the above, when the number of pixels in line direction for a unit block is increased more than that in row direction, the data signal writing time can be easily increased in comparison with an instance wherein the number of pixels both in line and row directions for a unit block is equal, even under a condition that their reduction rates of the signal clock frequency (Np/(nl×nr)) is the same.

In particular, when number of pixels in line direction for a unit block is 1 as in the present embodiment 5, nl×nr=nl, therefore, if the number Np of the specific patterns to be added is smaller than the number of pixels which constitute a unit block, advantages of reducing the signal clock frequency and of increasing the data signal writing time can be obtained at the same time, which will be understood from the equations (2) and (4).

Further, in the LC panel 36 as shown in FIG. 11, to the pixels, for example pixels 48*a* and 48*b*, which are connected to a common scan line and signal line, a same signal voltage is applied, however, the opposing signal voltages can respectively be applied independently.

Therefore, although in the embodiment 5 the unit block of 4×1 pixels is dealt, unit blocks of such as 2×1 pixels, 2×2 pixels and 4×4 pixels can also be used.

In the case of a unit block of 2×2 pixels, for example, it is dealt that the pixels 48*e*, 48*f*, 48*g* and 48*h* belong to a unit block and when an address signal is given to the scan line 41*a* and two pixel lines including the block constituted by the pixels 48*e*, 48*f*, 48*g* and 48*h* are selected, and when voltages $a_2$ and $-a_2$ are respectively applied to the signal lines 42R1 and 42R2, and voltages $-a_0$ are respectively applied to the opposing signal common lines 44R1*a*, 44R1*b*, 44R2*a*, 44R2*b*, the voltages applied to the LCs for the pixels 48*e*, 48*f*, 48*g* and 48*h* are respectively $a_0+a_2$, $a_0-a_2$, $a_0+a_2$, $a_0-a_2$, thereby, the block constituted by the above four pixels forms the specific pattern as shown in FIG. 4F.

As will be apparent from the above, when 2×2 pixels are dealt as a unit block, the specific patterns can be displayed to form a picture image.

As will be understood from the above, if the number of pixels for constituting a unit block are the same, the unit blocks can be modified in real time such as from a unit block of 2×2 pixels to a unit block of 4×1 pixels vice versa. Namely, depending on the concerned picture images, the unit block of 2×2 pixels and the unit block of 4×1 pixels can be exchanged.

Normally, when the unit block of 4×1 pixels is used, a picture quality deterioration is large, but data signal writing time increases in comparison with the unit block of 2×2 pixels.

Therefore, if a priority is placed on the picture quality, it is preferable to use the unit block of 2×2 pixels.

Further, when picture images are processed with the unit block of 2×2 pixels, and if totally the same signals are applied to all of the pixels in the unit block so as to permit the unit block of 2×2 pixels to deal as if one pixel, the processing can be switched to that with a unit block of 4×4 pixels.

Because, the identical signal is sent to the block of 2×2 pixels contained in a block of 4×4 pixels, the processing with the block of 4×4 pixels is substantially equivalent to that with a block of 2×2 pixels.

Therefore, the processing is normally performed with the block of 2×2 pixels, but if a picture image display with a low resolution such as when displaying a motion picture on an entire screen is required, the processing is switched to that with the block of 4×4 pixels, thereby, the display device can efficiently respond to the situations.

Embodiment 6

Figure 13:
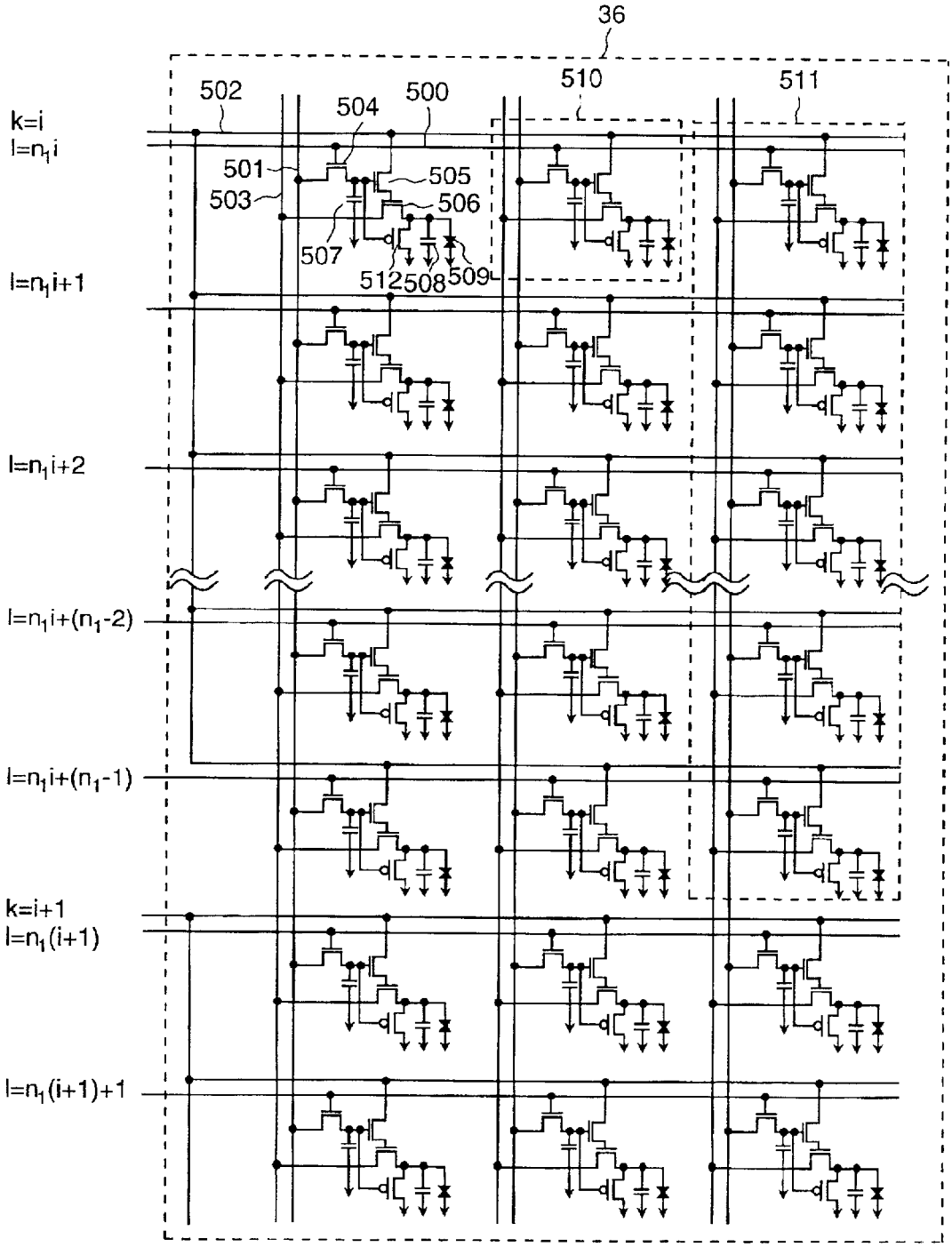
FIG. 13 is a diagram showing a structure of embodiment 6 of a display device according to the present invention.

FIG. 13 is a diagram showing a structure of embodiment 6 of a display device according to the present invention. The present embodiment 6 is substantially the same as the embodiment 1 except that the LC panel as shown in FIG. 13 is used instead of the of the LC panel 36 as shown in FIG. 6.

Further, since the cross sectional structure of the pixel portion of the present embodiment 6 is substantially the same as that of the embodiment 1 as shown in FIG. 7, the explanation thereof is omitted here. However, the TFT was prepared by making use of poly silicon. Hereinbelow, the structure of the LC panel 36 and the data signal writing timing of the present embodiment will be explained.

A block 511 is constituted by nl pieces of pixels 510 which are connected to a same analogue signal scan line 502 and a same analogue signal line 503. Each of the pixels 510 is constituted by a first transistor which is connected to a digital signal scan line 500 and a digital signal line 501, a first capacitance element 507, a second transistor 505 which is connected to the analogue signal scan line 502, a third transistor 506 which is connected to the analogue signal line 503, a second capacitance element 508, an LC 509 and a fourth transistor 512.

The first transistor 504, the second transistor 505 and the third transistor 506 are respectively n channel type MOS transistors, and the fourth transistor 512 is a p channel type MOS transistor.

The first capacitance element 507 and the second capacitance element 508 are formed with common wiring lines (not shown).

The first transistor 504 is selected by the digital signal scan line 500, samples the signal from the digital signal line 501 and holds the same in the first capacitance element 507. The signals from the digital signal line 501 are basically binary, and one is lower than a threshold voltage value of the second transistor 505 and the other is higher than the threshold voltage value thereof.

The first transistor 504 and the first capacitance element 507 operate as one bit memory and control the second transistor 505 and the fourth transistor 512.

The second transistor 505 is on/off controlled in response to the voltage of the first capacitance element 507. During when the second transistor 505 is turned on, the operation of the third transistor 506 is controlled by a selection pulse at the analogue signal scan line 502.

The third transistor 506 is selected by the analogue signal scan line 502 via the second transistor 505, samples the signal at the analogue signal line 503, holds the same at the second capacitive element 508 and controls the operation of the LC 509.

The fourth transistor 512 operates complementarily to the first transistor 504, and during the operation thereof discharges the electric charge written in the second capacitance element 508 and the LC 509.

After writing in advance one bit data into the first capacitive elements of the respective pixels through the digital signal scan line 500 and the digital signal line 501, a voltage is applied by the analogue signal scan line 502 and the analogue signal line 503.

Onto the LCs 509 for the respective pixels in each block 511 the signal at the analogue signal line 503 in response to one bit data and the voltage of the common wirings are applied.

Now, the signal writing timing will be explained.

With regard to timing for mapping of one bit data and for writing of an analogue signal to be applied onto the LC 509, the following timings can be used:

1) After mapping one bit data over the entire screen, blocks are selected for every pixel lines and a same signal is applied on the respective pixels in the selected blocks.

2) After mapping one bit data onto the respective pixels within ith (i is a natural number) block, a same signal is applied onto the respective pixels within the ith block.

3) After mapping one bit data on the respective pixels within ith through jth blocks (wherein j is a natural number larger than i), blocks among ith through jth blocks are selected for every pixel line and a same signal is applied onto the respective pixels within the selected blocks.

4) Mapping operation of one bit data and writing operation of an analogue signal are performed at the same time, in that the former for the blocks connected to one analogue signal scan line and the later for the blocks connected to another separate analogue signal scan line. Thereby, the data signal writing time is prolonged and a highly fine display can be easily effected.

After mapping one bit digital data onto respective pixels by making use of one of the above four methods and when a same analogue signal is applied onto all of the pixels under "1" state within predetermined blocks, a block of any size can be formed. With the above measure, like the above embodiment 5, the number of pixels in line direction in a block can be determined larger than the number of pixels in row direction, thereby, advantages of reducing the signal clock frequency and of increasing the data signal writing time can be obtained.

Embodiment 7

Figure 14:
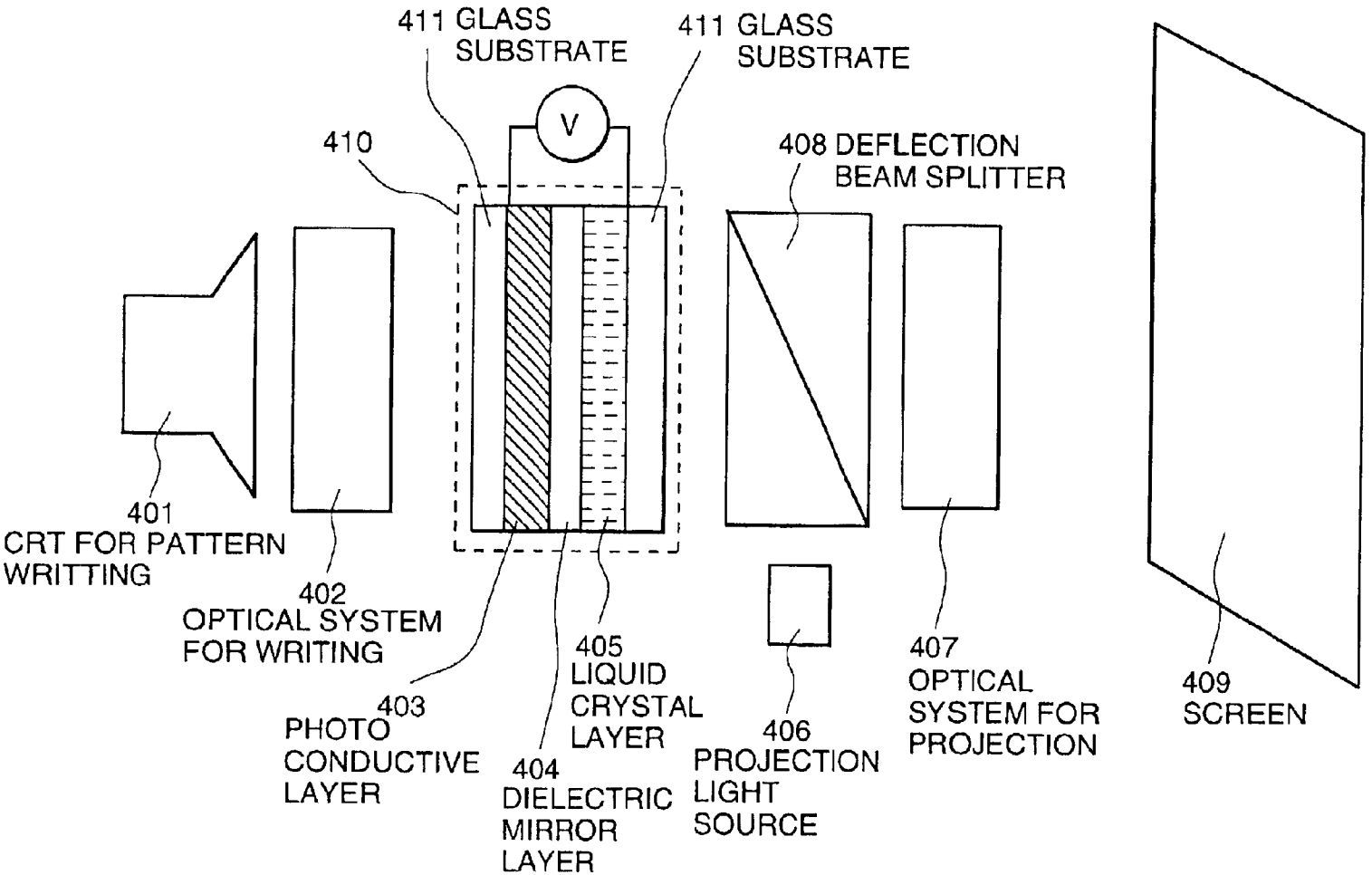
FIG. 14 is a diagram showing a structure of a projection type display representing embodiment 7 of a display device according to the present invention.

FIG. 14 is a diagram showing a structure of embodiment 7 of a display device in a form of a projection type display according to the present invention. The present embodiment 7 is substantially the same as the embodiment 1 except that the projection type display as shown in FIG. 14 is used instead of the display module 31 in FIG. 6. Therefore, the only the projection type display will be explained hereinbelow.

As shown in FIG. 14, the projection type display is constituted by a pattern writing CRT 401, a writing optical system 402, a pattern display element 410, a projection light source 406, a projection optical system 407, a deflection beam splitter 408 and a screen 409.

The pattern display element 410 is constituted by two pieces of glass substrates 411 on which transparent electrodes (not shown) are formed, a photo conductive layer 403 formed on the transparent electrode, a dielectric mirror layer 404 formed on the photo conductive layer 403 and an LC layer 405 sandwitched between the two pieces of glass substrates 411.

On the pattern writing CRT 401 the specific patterns such as shown in FIGS. 4E through 4H are sequentially displayed for every subframe divided from one frame.

One of the specific patterns is transferred via the writing optical system 402 onto the photo conductive layer 403. On the photo conductive layer 403 a surface distribution of electric conductivity is induced depending on the light intensity of the transferred specific pattern, and the voltage applied on the LC layer 405 is controlled depending on the values of the electric conductivity.

On the other hand, the light of the projection light source 406 passes the LC layer 405 via the deflection beam splitter 408, is reflected by the dielectric mirror layer 404 and again passes the LC layer 405, therefore, the light is controlled by the LC layer 405.

As a result, the reflection light reflected by the dielectric mirror layer 404 is controlled depending on the light intensity of the concerned specific pattern.

Subsequently, the reflected light passes the beam splitter 408 and is projected by the projection optical system 407 on the screen 409.

In the above optical system, the voltage applied onto the LC layer 405 is an effective value produced by a plurality of specific patterns being sequentially transferred. Therefore, a desired video image is produced on the screen 409 in the same manner as in the previous embodiment.

According to the present embodiment 7, the picture images displayed by the pattern writing CRT 401 are limited to the specific patterns, therefore, a simple and easily available CRT can be used.

Further, the pattern writing is performed not by the LC module but by a high speed driven CRT, therefore, number of specific patterns to be added can be increased in order to enhance picture quality.

Still further, the projection pattern display source is not limited to the pattern writing CRT 401, but a usual active matrix type LC display device can be used while applying the display principle according to the present invention.

Embodiment 8

Figure 15:
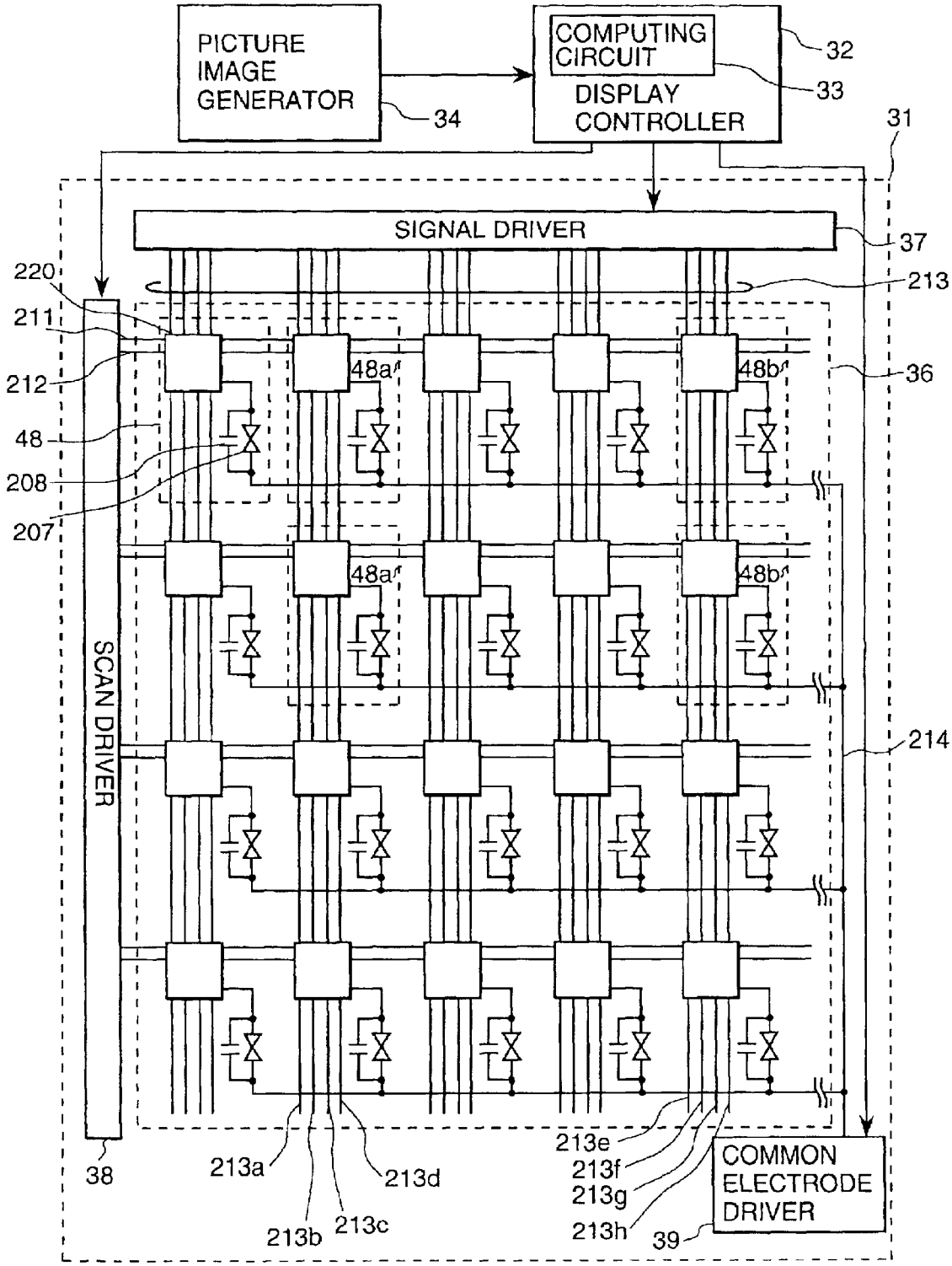
FIG. 15 is a diagram showing a structure of embodiment 8 of a display device according to the present invention.

FIG. 15 is a diagram showing the structure of embodiment 8 of a display unit according to the present invention. The display device of the embodiment 8 is an LC display device which makes use of an LC panel as a display panel 36. As shown in FIG. 15, the LC display device of the embodiment 8 is provided with the LC panel 36 in which pixels 48 are arranged in a matrix shape, a signal driver 37, a scan driver 38 and a common electrode driver 39 and is further provided with a display module 31 which determines a plurality of pixels to belong one block unit, selects the plurality of pixels in the block unit at the same time and forms and displays a picture image by adding one or a plurality of specific patterns each having different spatial frequencies, a display control unit 32 which controls the display module 31, a computing circuit 33 which generates the specific patterns each having different spatial frequencies based on picture image signals for every block while weighting the same and a picture image signal generating unit 34 which generates the picture image signals.

To the signal driver 37 signal lines 213 are connected, to the scan driver 38 first scan lines 211 and second scan lines 212 are connected and to the common electrode driver 39 common electrode lines 214 are connected.

Each of the pixels 48 is provided with an adder-subtractor 220, a capacitance element 208, and a signal electrode (not shown) and an opposing signal electrode (not shown) which apply a voltage to an LC element 207, the signal electrode is connected to one of the signal lines 213 via the adder-subtractor 220 and the common electrode is connected one of the common electrode lines 214.

Further, an R pixel, a G pixel and a B pixel are successively arranged in this order in the row direction.

Since the cross sectional structure of the pixel portion of the present embodiment 8 is substantially the same as that of the embodiment 1 as shown in FIG. 7, the explanation thereof is omitted here.

Figure 16A:
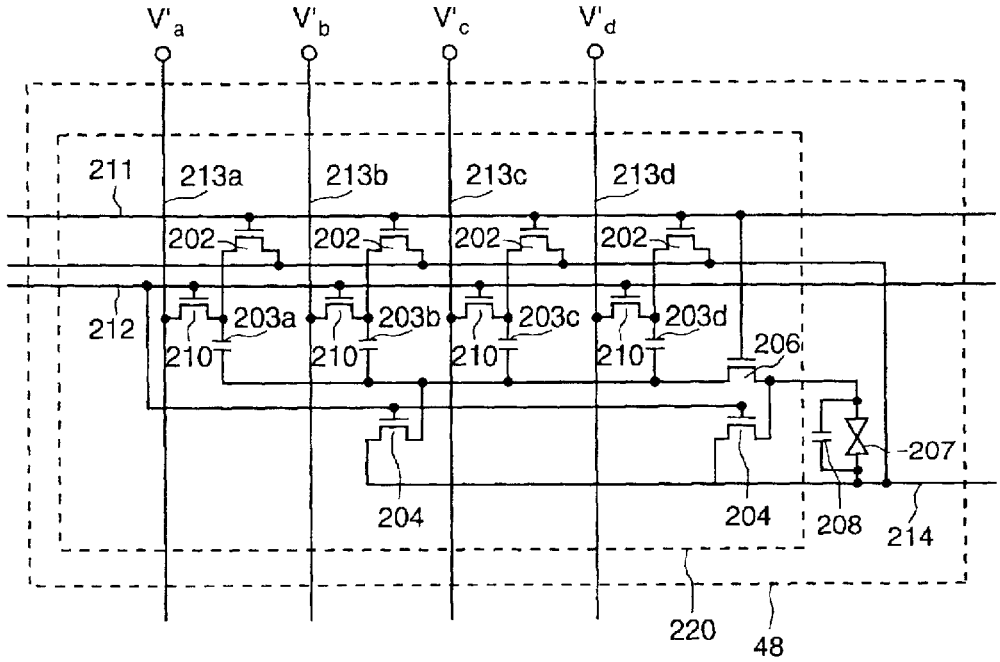
FIGS. 16A and 16B are diagrams for explaining a structure and operation of an adder-subtractor 220 in FIG. 15.
Figure 16B:
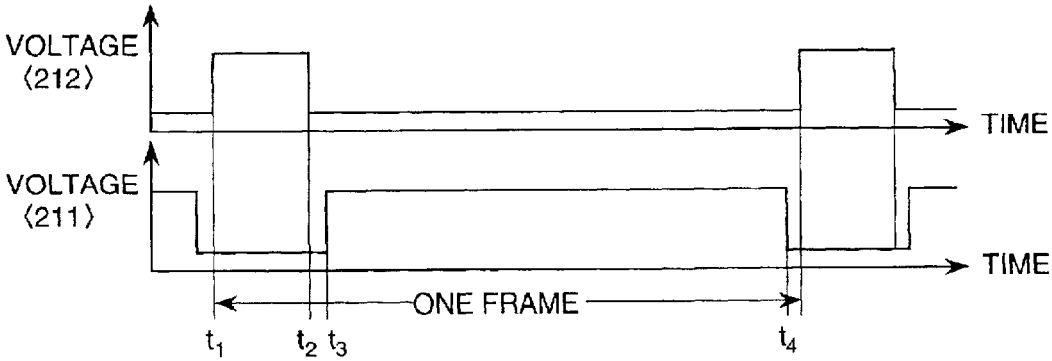

FIGS. 16A and 16B are diagrams for explaining the structure and operation of the adder-subtractor 220 as shown in FIG. 15. The adder-subtractor 220 is provided with a first TFT 201, a second TFT 202, a third TFT 204, a fourth TFT 205 and a fifth TFT 206 and capacitance elements 203*a* through 203*d*. The capacitances of the capacitance elements 203*a* through 203*d* are all the same of $C_{sig}$.

The capacitance elements 203*a* through 203*d* are connected via the first TFT 201 to respective signal lines 213*a* through 213*d*, further, connected via the second and third TFTs 202 and 204 to the common line 214 and still further connected via the fifth TFT 206 to the LC 207 and the capacitance element 208.

When an address signal is given to the second scan line 212 at time $t_1$ in FIG. 16B, and the first TFT 201, the third TFT 204 and the fourth TFT 205 are selected, the voltages applied to the signal lines 213*a*, 213*b*, 213*c* and 213*d* are respectively held at the capacitance elements 203*a* through 203*d*.

At the same time, the charges stored in the capacitance element 208 and the LC 207 are reset.

Herein, when it is assumed that the voltages given to the signal lines 213*a*, 213*b*, 213*c* and 213*d* are respectively as $V'_a$, $V'_b$, $V'_c$ and $V'_d$, the electric charge stored in the capacitance elements 203*a* through 203*d* is $C_{sig}$ $(V'_a+V'_b+V'_c+V'_d)$ in total.

Subsequently, when the first TFT 201, the third TFT and the fourth TFT 205 are turned off at time $t_2$ in FIG. 16B, an address signal is given to the scan line 211 at time $t_3$ and the second TFT 202 and the fifth TFT 206 are selected, the electric charge $C_{sig}$ $(V'_a+V'_b+V'_c+V'_d)$ stored in the capacitance elements 203*a*, 203*b*, 203*c* and 203*d* is redivided to the capacitance elements 203*a*, 203*b*, 203*c* and 203*d* and the LC 207.

Now, when it is assumed that the capacitance of the LC 207 and the capacitance of the capacitance element 208 are respectively $C_{lc}$ and $C_{stg}$, a voltage $V_{lc}$ applied to the LC 207 is expressed by the following equation (10):

$$V_{lc} = \frac{C_{stg}}{4C_{stg} + C_{stg} + C_{lc}}(V'_a + V'_b + V'_c + V'_d) \tag{10}$$

As will be understood from the above, a voltage proportional to the summation of the voltages applied to the signal lines 213*a*, 213*b*, 213*c* and 213*d* is applied to the LC 207.

Now, how weighting on the respective specific patterns each having different spatial frequencies is executed in the computing circuit 33 in FIG. 15 will be explained.

In the present embodiment 8, since the specific patterns each having different spatial frequencies are added by means of the adder-subtractor within each pixel, Hadamard transformation which is a general orthogonal transformation is used in the computing circuit 33 instead of "pseudo orthogonal transformation method" as indicated in equations (5).

Herein, the transformation will be explained with reference to, for example, a unit block of 2×2 pixels in two pieces in line direction and in two pieces in row direction constituted by pixels 48*a*, 48*b*, 48*c* and 48*d* as shown in FIG. 15. At first, depending on gradation signals $x_a$, $x_b$, $x_c$ and $x_d$ for the pixels 48*a*, 48*b*, 48*c* and 48*d* which are sent from the picture image signal generation unit 34, the "target voltages" $V_a$, $V_b$, $V_c$ and $V_d$ to be applied to the respective LCs are determined based on the transmittance-voltage characteristic of LC as shown in FIG. 5.

When the "pseudo orthogonal transformation method" is used, it is required to satisfy the equations (9), however, in the present embodiment such is not required. Therefore, with regard to the transmittance-voltage characteristic of LC no such steep characteristic as shown in FIG. 5 is required.

Subsequently, Hadamard transformation as indicated in the following equations (11) is applied to the "target voltages" $V_a$, $V_b$, $V_c$ and $V_d$ to determine weights $a'_j$ (j=1, 2, 3, 4) for the respective specific patterns:

$$\begin{cases} a_1 = C_0(V_a + V_b + V_c + V_d) \\ a_2 = C_0(V_a - V_b + V_c - V_d) \\ a_3 = C_0(V_a + V_b - V_c - V_d) \\ a_4 = C_0(V_a - V_b - V_c + V_d) \end{cases} \tag{11}$$

$$C_0 = \frac{4C_{stg} + C_{stg} + C_{lc}}{4C_{stg}} \tag{12}$$

Wherein, the above coefficient $C_0$ is somewhat different from that in a normal Hadamard transformation, this is because the reverse transformation is different from a normal Hadamard transformation as shown in the above equation (10).

Figure 17A:
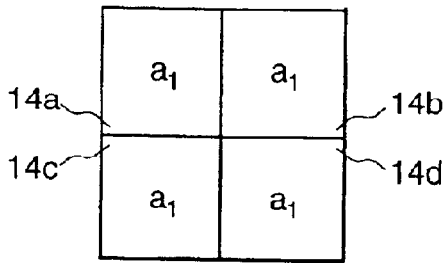
FIGS. 17A through 17D are diagrams for explaining specific patterns in the present invention.
Figure 17B:
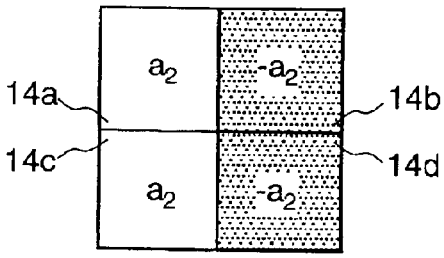
Figure 17C:
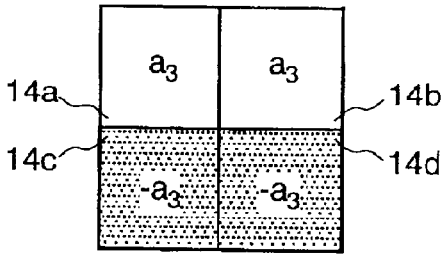
Figure 17D:
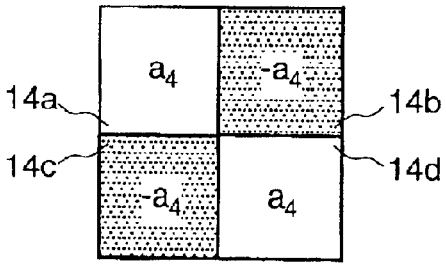

FIGS. 17A through 17E are diagrams showing a relationship between obtained weights aj and the specific patterns. The specific pattern corresponding to weight $a_1$ is formed by applying the signal voltages $a_1$, $a_1$, $a_1$, $a_1$ onto the pixels 14*a*, 14*b*, 14*c* and 14*d* as shown in FIG. 17A. The specific pattern corresponding to weight $a_2$ is formed by applying the signal voltages $a_2$, $-a_2$, $a_2$, $-a_2$ onto the pixels 14*a*, 14*b*, 14*c* and 14*d* as shown in FIG. 17B. The specific pattern corresponding to weight $a_3$ is formed by applying the signal voltages $a_3$, $a_3$, $-a_3$, $-a_3$ onto the pixels 14*a*, 14*b*, 14*c* and 14*d* as shown in FIG. 17C. The specific pattern corresponding to weight $a_4$ is formed by applying the signal voltages $a_4$, $-a_4$, $-a_4$, $a_4$ onto the pixels 14*a*, 14*b*, 14*c* and 14*d* as shown in FIG. 17D.

Now, when it is identified that a pixel to which a positive signal is applied presents white color and a pixel to which a negative signal is applied presents gray color, it will be understood that four specific patterns each having different spatial frequencies are formed as shown in FIGS. 17A through 17D.

When these specific patterns are added in the respective pixels which will be explained below, an original picture image can be reproduced.

Now, the pixels 48*a*, 48*b*, 48*c* and 48*d* as shown in FIG. 15 are noted. When the second scan line 212 to which the pixels 48*a* and 48*b* are connected is selected, voltage signals $a_1$, $a_1$, are respectively applied to the signal lines 213*a*, 213*e*, voltage signals $a_2$, $-a_2$ are respectively applied to the signal lines 213*b*, 213*f*, voltage signals $a_3$, $a_3$ are respectively applied to the signal lines 213*c*, 213*g* and voltage signals $a_4$, $-a_4$ are respectively applied to the signal lines 213*d*, 213*h*.

Subsequently, when the second scan line 212 is rendered off and the first scan line 211 is selected, voltages according to the equation (10) are applied onto the LCs 207 for the pixels 48*a*, 48*b*. Namely, the voltages $V_{lca}$, $V_{lcb}$ applied onto the LCs 207 for the pixels 48*a*, 48*b* are expressed by the following equations (13), thereby, the "target voltages" are applied:

$$\begin{cases} V_{lca} = \frac{1}{4C_0}(a_1 + a_2 + a_3 + a_4) = \frac{1}{4C_0}4C_0V_a = V_a \\ V_{lcb} = \frac{1}{4C_0}(a_1 - a_2 + a_3 - a_4) = \frac{1}{4C_0}4C_0V_b = V_b \end{cases} \tag{13}$$

The above operation implies that among the specific patterns as shown in FIGS. 17A through 17D the addition of the specific patterns relating to the pixels 14*a*, 14*b* has been completed.

Now, when the second scan line 212 to which the pixels 48*c* and 48*d* are connected is selected, voltage signals $a_1$, $a_1$, are respectively applied to the signal lines 213*a*, 213*e*, voltage signals $a_2$, $-a_2$ are respectively applied to the signal lines 213*b*, 213*f*, voltage signals $a_3$, $a_3$ are respectively applied to the signal lines 213*c*, 213*g* and voltage signals $a_4$, $a_4$ are respectively applied to the signal lines 213*d*, 213*h*.

Subsequently, when the second scan line 212 is rendered off and the first scan line 211 is selected, voltages according to the equation (10) are applied onto the LCs 207 for the pixels 48*c*, 48*d*. Namely, the voltages $V_{lcc}$, $V_{lcd}$ applied onto the LCs 207 for the pixels 48*c*, 48*d* are expressed by the following equations (14), thereby, the "target voltages" are applied:

$$\begin{cases} V_{lcc} = \frac{1}{4C_0}(a_1 + a_2 - a_3 - a_4) = \frac{1}{4C_0}4C_0V_c = V_c \\ V_{lcd} = \frac{1}{4C_0}(a_1 - a_2 - a_3 + a_4) = \frac{1}{4C_0}4C_0V_d = V_d \end{cases} \tag{14}$$

The above operation implies that among the specific patterns as shown in FIGS. 17A through 17D the addition of the specific patterns relating to the pixels 14*c*, 14*d* has been completed.

As will be apparent from the above, at the moment when the scanning of two pixel lines have been completed, the addition of the specific patterns for the block of 2×2 pixels has been completed.

In the same manner, when all of the pixel lines have been scanned, the scanning has been completed for all of the blocks and the original picture image is reproduced.

Different from the embodiments using the "pseudo orthogonal transformation method", in the present embodiment 8, when the scanning is once performed for all of the pixel lines, the voltage adding operation is completed which unnecessitates dividing one frame into a plurality of subframes.

According to the present embodiment 8, the following advantages can be obtained.

Since the picture image is displayed by once scanning all of the pixel lines, the signal data writing time is constant without being affected by the size of the respective blocks.

Further, since the display can be performed only by adding parts of the specific patterns of which weights are determined according to the equations (11), the signal clock frequency can be reduced in the same principle as in the "pseudo orthogonal transformation method".

Still further, since the present embodiment uses a general Hadamard transformation, the load to the computing circuit 33 is limited and a high speed computation can be realized.

Further, with regard to the number of the first TFTs 201, the second TFTs 202 and the capacitance elements 203 (203*a*~203*d*) in FIG. 16A, it is enough if such are prepared in the number corresponding to the number Np of specific patterns to be added.

Embodiment 9

Figure 18:
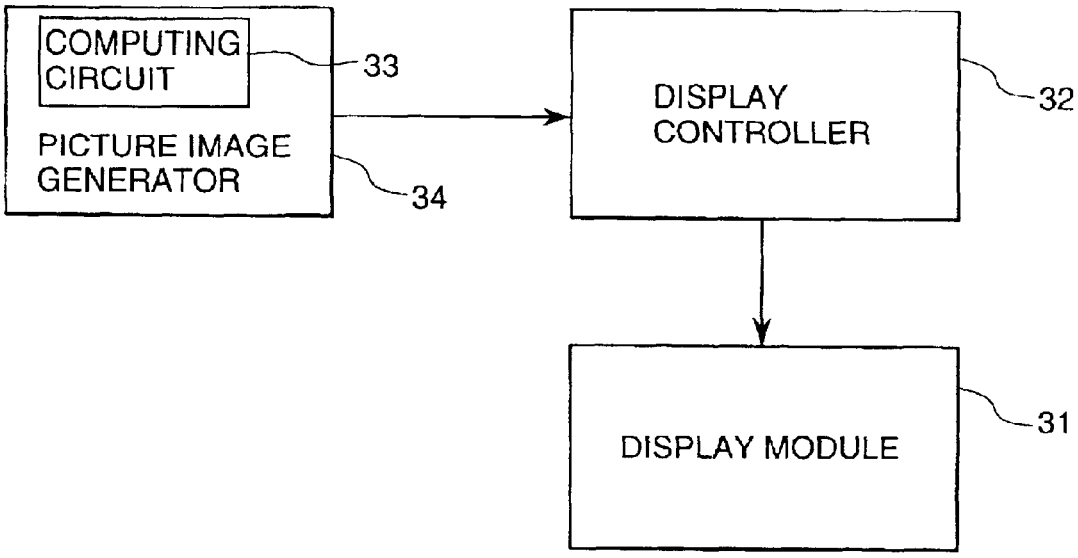
FIG. 18 is a diagram showing a structure of embodiment 9 of a display device according to the present invention.

FIG. 18 is a diagram showing a structure of embodiment 9 of a display device according to the present invention. As shown in FIG. 18, the present embodiment 9 is substantially the same as the embodiment 2 except that the computing circuit 33 is included in the picture images signal generation unit 34 other than the display control unit 32 as in FIG. 8.

According to the present embodiment 9, not only the amount of signal sent from the display control unit 32 to the display module 31 is cut short but also the amount of signal sent from the picture image signal generation unit 34 to the display control unit 32 is reduced, thereby, a display device which permits a highly fine display can be easily realized.

Figure 19:
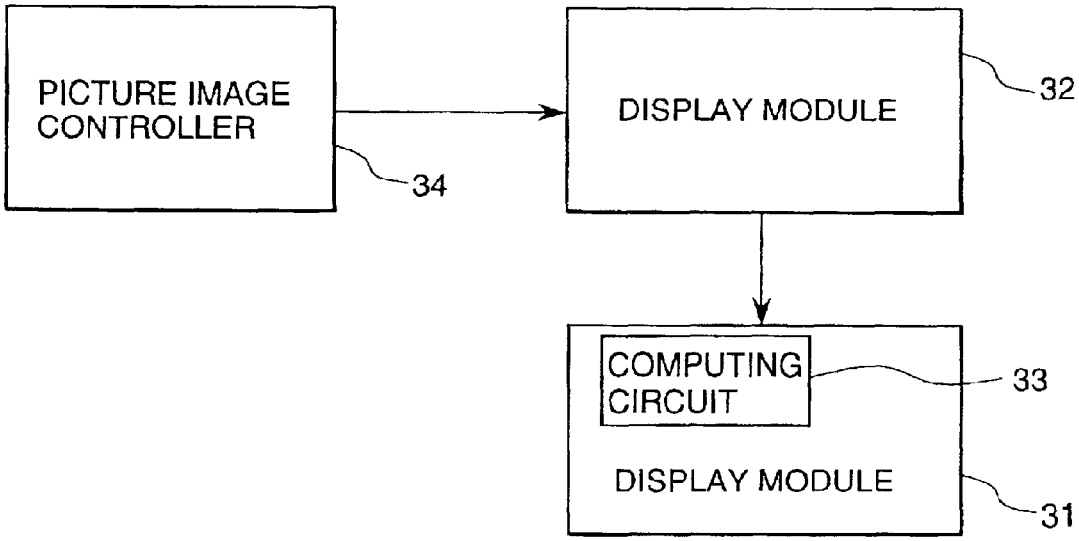
FIG. 19 is a diagram showing a structure of embodiment 10 of a display device according to the present invention.

FIG. 19 is a diagram showing a structure of embodiment 10 of a display device according to the present invention. As shown in FIG. 19, the present embodiment 9 is substantially the same as the embodiment 5 except that the computing circuit 33 is included in the display module 31 other than the display control unit 32 as in FIG. 11.

According to the present embodiment 10, the picture image signal generation unit 34 and the display control unit 32 which are commercially available can be utilized and, in addition, an advantage of increasing the data signal writing time can be obtained.

According to the present invention, through the provision of a display module in a display device which displays a picture image by adding one or a plurality of specific patterns each having different spatial frequencies, a display device can be obtained which reduces the signal clock frequency as well as increases the signal writing time, enhances the opening rate of an LC panel and permits a highly fine display and a high speed motion picture display.

What is claimed is:

1. A display device comprising a display module which determines a plurality of n (n is an integer equal to or more than 2) pieces of pixels as belonging to one block unit, selects the plurality of pixels in each block unit at the same time and displays a picture image by adding one or a plurality of specific patterns each having different spatial frequencies of each block unit; a display control unit which controls the display module; a picture image signal generation unit which generates picture image signals; and a computing circuit which generates the specific patterns each having different spatial frequencies while weighting the same based on the picture image signals for every block unit;

wherein the computing circuit is a means for generating n pieces of specific patterns each having different spatial frequencies which are weighted based on the picture image signals for every block unit, and the display module is a means for displaying a picture image by adding Np (which is an integer smaller than n) pieces of the specific patterns; and, a compression rate regulation unit which modifies the number of pieces Np of the specific patterns to be applied.

2. A display device comprising a display module which determines a plurality of n (n is an integer equal to or more than 2) pieces of pixels as belonging to one block unit, selects the plurality of pixels in each block unit at the same time and displays a picture image by adding one or a plurality of specific patterns each having different spatial frequencies of each block unit; a display control unit which controls the display module; a picture image signal generation unit which generates picture image signals; and a computing circuit which generates the specific patterns each having different spatial frequencies while weighting the same based on the picture image signals for every block unit;

wherein the computing circuit is a means for generating n pieces of specific patterns each having different spatial frequencies which are weighted based on the picture image signals for every block unit, and the display module is a means for displaying a picture image by adding Np (which is an integer smaller than n) pieces of the specific patterns; and, a high compression rate computing circuit which modifies the number of the specific patterns to be added for every block unit.

3. A display device comprising a display module which determines a plurality of n (n is an integer equal to or more than 2) pieces of pixels as belonging to one block unit, selects the plurality of pixels in each block unit at the same time and displays a picture image by adding one or a plurality of specific patterns each having different spatial frequencies of each block unit; a display control unit which controls the display module; a picture image signal generation unit which generates picture image signals; and a computing circuit which generates the specific patterns each having different spatial frequencies while weighting the same based on the picture image signals for every block unit;

wherein the display module includes a panel in which the pixels are arranged in a matrix shape, a signal driver, a scan driver and opposing signal driver; signal lines connected to the signal driver; scan lines connected to the scan driver; and opposing signal lines connected to the opposing signal driver; each of the pixels includes a signal electrode, opposing signal electrode and a switch element, the signal electrode is connected to one of the signal lines via the switch element, the opposing signal electrode is connected to one of the opposing signal lines, a first potential is applied to the signal electrodes provided for the pixels on a same line included in a same block unit, a second potential is applied to the opposing signal electrodes provided for the pixels on a same row included in the same block unit, a certain specific pattern is formed by the first and second potentials for the same block unit concerned and one of the common opposing signal lines is connected to the opposing signal electrodes provided for the pixels on the same line.

4. A display device comprising a display module which determines a plurality of n (n is an integer equal to or more than 2) pieces of pixels as belonging to one block unit, selects the plurality of pixels in each block unit at the same time and displays a picture image by adding one or a plurality of specific patterns each having different spatial frequencies of each block unit; a display control unit which controls the display module; a picture image signal generation unit which generates picture image signals; and a computing circuit which generates the specific patterns each having different spatial frequencies while weighting the same based on the picture image signals for every block unit;

wherein the computing circuit is a means for generating n pieces of specific patterns each having different spatial frequencies which are weighted based on the picture image signals for every block unit, and the display module is a means for displaying a picture image by adding Np (which is an integer smaller than n) pieces of the specific patterns; and, wherein the display module includes a panel in which the pixels are arranged in a matrix shape, a signal driver, a scan driver and opposing signal driver; signal lines connected to the signal driver; scan lines connected to the scan driver; and opposing signal lines connected to the opposing signal driver; each of the pixels includes a signal electrode, opposing signal electrode and a switch element, the signal electrode is connected to one of the signal lines via the switch element, the opposing signal electrode is connected to one of the opposing signal lines, a first potential is applied to the signal electrodes provided for the pixels on a same line included in a same block unit, a second potential is applied to the opposing signal electrodes provided for the pixels on a same row included in the same block unit, a certain specific pattern is formed by the first and second potentials for the same block unit concerned and one of the common opposing signal lines is connected to the opposing signal electrodes provided for the pixels on the same line.

5. A display device according to claim 1, wherein the display module includes a panel in which the pixels are arranged in a matrix shape, a signal driver, a scan driver and opposing signal driver; signal lines connected to the signal driver; scan lines connected to the scan driver; and opposing signal lines connected to the opposing signal driver; each of the pixels includes a signal electrode, opposing signal electrode and a switch element, the signal electrode is connected to one of the signal lines via the switch element, the opposing signal electrode is connected to one of the opposing signal lines, a first potential is applied to the signal electrodes provided for the pixels on a same line included in a same block unit, a second potential is applied to the opposing signal electrodes provided for the pixels on a same row included in the same block unit, a certain specific pattern is formed by the first and second potentials for the same block unit concerned and one of the common opposing signal lines is connected to the opposing signal electrodes provided for the pixels on the same line.

6. A display device according to claim 2, wherein the display module includes a panel in which the pixels are arranged in a matrix shape, a signal driver, a scan driver and opposing signal driver; signal lines connected to the signal driver; scan lines connected to the scan driver; and opposing signal lines connected to the opposing signal driver; each of the pixels includes a signal electrode, opposing signal electrode and a switch element, the signal electrode is connected to one of the signal lines via the switch element, the opposing signal electrode is connected to one of the opposing signal lines, a first potential is applied to the signal electrodes provided for the pixels on a same line included in a same block unit, a second potential is applied to the opposing signal electrodes provided for the pixels on a same row included in the same block unit, a certain specific pattern is formed by the first and second potentials for the same block unit concerned and one of the common opposing signal lines is connected to the opposing signal electrodes provided for the pixels on the same line.

7. A display device comprising a display module which determines a plurality of n (n is an integer equal to or more than 2) pieces of pixels as belonging to one block unit, selects the plurality of pixels in each block unit at the same time and displays a picture image by adding one or a plurality of specific patterns each having different spatial frequencies of each block unit; a display control unit which controls the display module; a picture image signal generation unit which generates picture image signals; and a computing circuit which generates the specific patterns each having different spatial frequencies while weighting the same based on the picture image signals for every block unit;

wherein the display module includes a panel in which the pixels are arranged in a matrix shape, a signal driver, a scan driver and opposing signal driver; signal lines connected to the signal driver; scan lines connected to the scan driver; opposing signal common lines connected to the opposing signal driver and opposing signal lines connected to the opposing signal common lines; each of the pixels includes a signal electrode, opposing signal electrode and a switch element, the signal electrode is connected to one of the signal lines via the switch element, the opposing signal electrode is connected to one of the opposing signal lines, a first potential is applied to the signal electrodes provided for the pixels on a same line included in a same block unit, a second potential is applied to the opposing signal electrodes provided for the pixels on a same row included in the same block unit, a certain specific pattern is formed by the first and second potentials for the same block unit concerned and one of different opposing signal lines is connected to the opposing signal electrodes provided for the pixels included in a different block unit.

8. A display device comprising a display module which determines a plurality of n (n is an integer equal to or more than 2) pieces of pixels as belonging to one block unit, selects the plurality of pixels in each block unit at the same time and displays a picture image by adding one or a plurality of specific patterns each having different spatial frequencies of each block unit; a display control unit which controls the display module; a picture image signal generation unit which generates picture image signals; and a computing circuit which generates the specific patterns each having different spatial frequencies while weighting the same based on the picture image signals for every block unit;

wherein the computing circuit is a means for generating n pieces of specific patterns each having different spatial frequencies which are weighted based on the picture image signals for every block unit, and the display module is a means for displaying a picture image by adding Np (which is an integer smaller than n) pieces of the specific patterns; and, wherein the display module includes a panel in which the pixels are arranged in a matrix shape, a signal driver, a scan driver and opposing signal driver; signal lines connected to the signal driver; scan lines connected to the scan driver; opposing signal common lines connected to the opposing signal driver and opposing signal lines connected to the opposing signal common lines; each of the pixels includes a signal electrode, opposing signal electrode and a switch element, the signal electrode is connected to one of the signal lines via the switch element, the opposing signal electrode is connected to one of the opposing signal lines, a first potential is applied to the signal electrodes provided for the pixels on a same line included in a same block unit, a second potential is applied to the opposing signal electrodes provided for the pixels on a same row included in the same block unit, a certain specific pattern is formed by the first and second potentials for the same block unit concerned and one of different opposing signal lines is connected to the opposing signal electrodes provided for the pixels included in a different block unit.

9. A display device according to claim 2, wherein the display module includes a panel in which the pixels are arranged in a matrix shape, a signal driver, a scan driver and opposing signal driver; signal lines connected to the signal driver; scan lines connected to the scan driver; opposing signal common lines connected to the opposing signal driver and opposing signal lines connected to the opposing signal common lines; each of the pixels includes a signal electrode, opposing signal electrode and a switch element, the signal electrode is connected to one of the signal lines via the switch element, the opposing signal electrode is connected to one of the opposing signal lines, a first potential is applied to the signal electrodes provided for the pixels on a same line included in a same block unit, a second potential is applied to the opposing signal electrodes provided for the pixels on a same row included in the same block unit, a certain specific pattern is formed by the first and second potentials for the same block unit concerned and one of different opposing signal lines is connected to the opposing signal electrodes provided for the pixels included in a different block unit.

10. A display device comprising a display module which determines a plurality of n (n is an integer equal to or more than 2) pieces of pixels as belonging to one block unit, selects the plurality of pixels in each block unit at the same time and displays a picture image by adding one or a plurality of specific patterns each having different spatial frequencies of each block unit; a display control unit which controls the display module; a picture image signal generation unit which generates picture image signals; and a computing circuit which generates the specific patterns each having different spatial frequencies while weighting the same based on the picture image signals for every block unit;

wherein the display module includes a panel in which the pixels are arranged in a matrix shape, a signal driver, a scan driver and opposing signal driver signal lines connected to the signal driver; scan lines connected to the scan driver; opposing signal common lines connected to the opposing signal driver and opposing signal lines connected to the opposing signal common lines; each of the pixels includes a signal electrode, opposing signal electrode and a switch element, the signal electrode is connected to one of the signal lines via the switch element, the opposing signal electrode is connected to one of the opposing signal lines, a first potential is applied to the signal electrodes provided for the pixels on a same line included in a same block unit, a second potential is applied to the opposing signal electrodes provided for the pixels on a same row included in the same block unit, a certain specific pattern is formed by the first and second potentials for the same block unit concerned and one of different opposing signal lines, is connected to the opposing signal electrodes provided for the pixels included in a different block unit, and respective different opposing signal lines are connected to the opposing signal electrodes provided for the pixels on different lines included in the same block unit.

11. A display device comprising a display module which determines a plurality of n (n is an integer equal to or more than 2) pieces of pixels as belonging to one block unit, selects the plurality of pixels in each block unit at the same time and displays a picture image by adding one or a plurality of specific patterns each having different spatial frequencies of each block unit; a display control unit which controls the display module; a picture image signal generation unit which generates picture image signals; and a computing circuit which generates the specific patterns each having different spatial frequencies while weighting the same based on the picture image signals for every block unit;

wherein the computing circuit is a means for generating n pieces of specific patterns each having different spatial frequencies which are weighted based on the picture image signals for every block unit, and the display module is a means for displaying a picture image by adding Np (which is an integer smaller than n) pieces of the specific patterns; and, wherein the display module includes a panel in which the pixels are arranged in a matrix shape, a signal driver, a scan driver and opposing signal driver; signal lines connected to the signal driver; scan lines connected to the scan driver; opposing signal common lines connected to the opposing signal driver and opposing signal lines connected to the opposing signal common lines; each of the pixels includes a signal electrode, opposing signal electrode and a switch element, the signal electrode is connected to one of the signal lines via the switch element, the opposing signal electrode is connected to one of the opposing signal lines, a first potential is applied to the signal electrodes provided for the pixels on a same line included in a same block unit, a second potential is applied to the opposing signal electrodes provided for the pixels on a same row included in the same block unit, a certain specific pattern is formed by the first and second potentials for the same block unit concerned and one of different opposing signal lines is connected to the opposing signal electrodes provided for the pixels included in a different block unit, and respective different opposing signal lines are connected to the opposing signal electrodes provided for the pixels on different lines included in the same block unit.

12. A display device according to claim 2, wherein the display module includes a panel in which the pixels are arranged in a matrix shape, a signal driver, a scan driver and opposing signal driver; signal lines connected to the signal driver; scan lines connected to the scan driver; opposing signal common lines connected to the opposing signal driver and opposing signal lines connected to the opposing signal common lines; each of the pixels includes a signal electrode, opposing signal electrode and a switch element, the signal electrode is connected to one of the signal lines via the switch element, the opposing signal electrode is connected to one of the opposing signal lines, a first potential is applied to the signal electrodes provided for the pixels on a same line included in a same block unit, a second potential is applied to the opposing signal electrodes provided for the pixels on a same row included in the same block unit, a certain specific pattern is formed by the first and second potentials for the same block unit concerned and one of different opposing signal lines is connected to the opposing signal electrodes provided for the pixels included in a different block unit, and respective different opposing signal lines are connected to the opposing signal electrodes provided for the pixels on different lines included in the same block unit.

13. A display device according to one of claims 1 through 12, wherein the number of pixels in line direction in a block unit is larger than the number of pixels in row direction in the block unit.

14. A display device according to one of claims 1 through 12, wherein a combination of a plurality of pixels which constitute a block unit is varied.

15. A display device according to one of claims 1 through 12, wherein the display module is a projection type display, and the projection type display includes a projection pattern display source which displays the specific patterns and a pattern display element, and the pattern display element includes a pair of substrates on which a transparent electrode is formed, a photo conductive layer formed on the transparent electrode and an LC layer sandwiched by the pair of substrates.

16. A display device according to one of claims 1 through 12, wherein the display module is constituted as a means for displaying picture images by sequentially adding the specific patterns.

17. A display device according to one of claims 1 through 12, wherein the display module is a means for displaying picture images while computing the specific patterns in the respective pixels and adding the same therein.

18. A display device according to claim 17, wherein the display module includes a panel in which the pixels are arranged in a matrix shape, a signal driver, a scan driver and a common electrode driver; signal lines connected to the signal driver; scan lines connected to the scan driver; and common electrode lines connected to the common electrode driver, each of the pixels is provided with an adder-subtractor for adding the specific patterns, and the signal lines of which number is equal to the number Np of specific patterns to be added are connected, to the adder-subtractor.

19. A display device according to claim 18, wherein the panel is an LC panel provided with an LC for the pixels, each of the pixels is provided with capacitance elements of more than Np pieces corresponding to the number of the specific patterns to be added which hold signals sent via the concerned signal lines, and means for coupling the capacitance element concerned and the capacitance of the LC.

20. A display device according to one of claims 1 through 12, wherein each circuit which constitutes each pixel includes a sample hold means for digital signal and another sample hold means for analogue signals.

21. A display device according to claim 20, wherein the signal held in the sample hold means for analogue signals is rewritten depending on the signal held in the sample hold means for digital signals to provide a same signal for the pixels included in a same block unit.

22. A display device according to one of claims 1 through 12, wherein the picture image signal generation unit includes the computing circuit.

23. A display device according to one of claims 1 through 12, wherein the display control unit includes the computing circuit.

24. A display device according to one of claims 1 through 12, wherein the display module includes the computing circuit.

25. A display device according to one of claims 1 through 12, wherein the display module is an LC display module.

26. A display device comprising a display module which determines a plurality of n (n is an integer equal to or more than 2) pieces of pixels as belonging to one block unit, selects the plurality of pixels in each block unit at the same time and displays a picture image by adding one or a plurality of specific patterns each having different spatial frequencies of each block unit; a display control unit which controls the display module; a picture image signal generation unit which generates picture image signals; and a computing circuit which generates the specific patterns each having different spatial frequencies while weighting the same based on the picture image signals for every block unit;

wherein the display module is a projection type display, and the projection type display includes a projection pattern display source which displays the specific patterns and a pattern display element, and the pattern display element includes a pair of substrates on which a transparent electrode is formed, a photo conductive layer formed on the transparent electrode and an LC layer sandwiched by the pair of substrates.

27. A display device according to claim 26, wherein the computing circuit is a means for generating n pieces of specific patterns each having different spatial frequencies which are weighted based on the picture image signals for every block unit, and the display module is a means for displaying a picture image by adding Np (which is an integer smaller than n) pieces of the specific patterns.

28. A display device comprising a display module which determines a plurality of n (n is an integer equal to or more than 2) pieces of pixels as belonging to one block unit, selects the plurality of pixels in each block unit at the same time and displays a picture image by adding one or a plurality of specific patterns each having different spatial frequencies of each block unit; a display control unit which controls the display module; a picture image signal generation unit which generates picture image signals; and a computing circuit which generates the specific patterns each having different spatial frequencies while weighting the same based on the picture image signals for every block unit;

wherein each circuit which constitutes each pixel includes a sample hold means for digital signal and another sample hold means for analogue signals.

29. A display device according to claim 28, wherein the computing circuit is a means for generating n pieces of specific patterns each having different spatial frequencies which are weighted based on the picture image signals for every block unit, and the display module is a means for displaying a picture image by adding Np (which is an integer smaller than n) pieces of the specific patterns.

* * * * *